US007735564B2

(12) United States Patent
Guerrero

(10) Patent No.: US 7,735,564 B2
(45) Date of Patent: Jun. 15, 2010

(54) LOGGING TOOL DEPLOYMENT SYSTEMS AND METHODS WITH PRESSURE COMPENSATION

(75) Inventor: Julio C. Guerrero, Cambridge, MA (US)

(73) Assignee: Schlumberger Technology Corporation, Cambridge, MA (US)

( * ) Notice: Subject to any disclaimer, the term of this patent is extended or adjusted under 35 U.S.C. 154(b) by 116 days.

(21) Appl. No.: 11/963,122

(22) Filed: Dec. 21, 2007

(65) Prior Publication Data

US 2009/0159273 A1 Jun. 25, 2009

(51) Int. Cl.
*E21B 23/00* (2006.01)

(52) U.S. Cl. ..... 166/379; 166/85.4

(58) Field of Classification Search ..... 166/378, 166/379, 85.4, 75.15
See application file for complete search history.

(56) References Cited

U.S. PATENT DOCUMENTS

| | | | | |
|---|---|---|---|---|
| 2,758,654 | A | 8/1956 | Simmons | |
| 3,926,260 | A | 12/1975 | Slator | |
| 4,971,148 | A | 11/1990 | Roche et al. | |
| 5,890,534 | A | 4/1999 | Burge et al. | |
| 6,056,055 | A | 5/2000 | Falconer et al. | |
| 6,328,111 | B1 | 12/2001 | Bearden et al. | |
| 6,712,147 | B2 * | 3/2004 | Dallas | 166/379 |
| 2005/0211442 | A1 * | 9/2005 | McGuire et al. | 166/379 |
| 2005/0217844 | A1 | 10/2005 | Edwards et al. | |

FOREIGN PATENT DOCUMENTS

| | | | |
|---|---|---|---|
| EP | 1157188 | B1 | 5/2005 |
| GB | 2047306 | A | 11/1980 |
| GB | 2347156 | A | 8/2000 |
| WO | 2006075181 | A | 7/2006 |

OTHER PUBLICATIONS

Guerrero et al., System and Methods for Actuating Reversibly Expandable Structures, U.S. Appl. No. 11/962,256, filed Dec. 21, 2007.

Guerrero et al., Logging tool Deployment Systems and Methods Without Pressure Compensation, U.S. Appl. No. 11/962,657, filed Dec. 21, 2007.

Patent Cooperation Treaty, International Search Report, dated Sep. 28, 2009, 6 pages.

* cited by examiner

*Primary Examiner*—William P Neuder
(74) *Attorney, Agent, or Firm*—Brigid Laffey; Vincent Loccisano; James McAleenan

(57) ABSTRACT

Systems and processes are provided for facilitating transfer of downhole devices through a reversibly sealable wellhead fixture capping a well under pressure, without jeopardizing operators, equipment, or the well itself. An open ended pressurizable vessel is provided that is sized and shaped to accommodate a substantial portion of a particular downhole device, such as a logging tool. The vessel includes a mating flange for coupling its open end to a reversibly sealable wellhead fixture. A pressure can be equalized between an internal cavity of the pressurizable vessel and the wellbore. Once the pressure has been equalized, a channel can be opened between the pressurizable vessel and the wellbore, allowing for transfer of the downhole device in a preferred direction, either into or out of the wellbore. One or more robotic systems can be provided to further expedite manipulation of at least one of the tool and the vessel.

35 Claims, 17 Drawing Sheets

LOGGING TOOL DEPLOYMENT SYSTEMS AND METHODS WITH PRESSURE COMPENSATION

FIELD OF THE INVENTION

The present invention relates generally to the field of transferring downhole devices through an open end of a well, and in particular to transferring such equipment through an open end of a well that may contain pressure, while protecting equipment and operators from exposure to such pressure.

BACKGROUND OF THE INVENTION

Underground formations encountered during exploration and production of a well may exist at elevated pressures. In many instances, the pressures are substantial enough to produce an elevated pressure at a wellhead. Failure to control such pressure differentials could result in an undesirable situation referred to as a blowout—an uncontrolled flow of reservoir fluids into the wellbore, and sometimes catastrophically to the surface.

Typically, a well might be fitted with a wellhead fixture to isolate wellbore pressures from an ambient pressure at an open end of the wellbore. During exploration and production, however, there remains a need to at least periodically install and/or remove downhole devices from the well. For example, logging tools designed to evaluate a formation and/or well conditions must be inserted into the wellbore, lowered to various depths as may be required during exploration, and later removed from the wellbore, without jeopardizing crew, equipment, or production of the well. Presently, transfer of such logging tools through an open of a well under pressure can be accomplished using specialized fixtures and techniques capable of maintaining a pressure barrier at the wellhead. One such class of fixtures is known generally as a Christmas tree, including a configuration of valves and access fittings. Another such class of wellhead fixtures is known generally as blowout preventors (BOPs). Either class of wellhead fixtures can be configured with facilities to enable safe access for well intervention apertures. For example, BOPs can include an open channel with one or more reversibly sealable elements configured to open to allow passage of the logging tool and closing thereafter to form a pressure barrier.

The process of putting drill pipe or other downhole devices into a life well under pressure when BOPs are closed and pressure is contained within the well is referred to as snubbing. If the well has been closed with a so-called ram-type BOP, larger diameter features of the downhole devices, such as tools or joints will not pass by the closed ram element. To keep the well closed another ram-type BOP or an annular BOP is included in series. The first ram element must be opened manually, then the downhole device lowered until the larger diameter feature is just below the ram element, and then closing the first ram element again. The second ram element is then opened allowing the larger diameter element to pass. This procedure is repeated whenever a larger diameter feature, such as a tool or tool joint must pass by a ram-type BOP. Exercising such care in dealing with larger diameter features by snubbing is generally a time consuming proposition.

If only an annular BOP has been closed rather than the ram-type BOP, the drill pipe or other downhole device may be slowly and carefully lowered into the wellbore, since the annular BOP opens slightly to permit the larger diameter feature to pass through. In snubbing operations, the pressure in the wellbore acting on the cross-sectional area of the tubular element (i.e., downhole device) can exert sufficient force to overcome the weight of a drill string, so the string must be pushed (or "snubbed") back into the wellbore. Such thrust can be provided by a coil tubing unit pushing to a proximal end of a tool or axial array of tools within the wellbore. Such an axial array of tools is referred to as a tool string.

Applying downhole axial thrust to such an elongated tool or string of tools generally requires the use of a rig or derrick providing lateral support to the tool or string of tools suspended above the wellhead fixture. Such strings are typically assembled vertically above a wellhead fixture before insertion, requiring tall rigs. The rig itself is constructed above the open end of the wellhead fixture and directed along the wellbore axis and may extend from 10 to 100 feet or more, depending upon the length of the tool or tool string. An array of multiple interconnected tools is referred to as a tool string. Such strings are typically assembled vertically above a wellhead fixture before insertion, requiring tall rigs. Unfortunately, construction of such a rig or derrick adds to time and complexity on-site during any such deployment and extraction procedure. The rigs must be provided, constructed, used, deconstructed and removed. Such on-site access time can be quite expensive, particularly for offshore applications, thus any procedures leading to delay, such as snubbing and rig construction, are highly undesirable.

SUMMARY OF THE INVENTION

Systems and processes are described for facilitating transfer of downhole devices through a reversibly sealable wellhead fixture capping a well under pressure, without jeopardizing operators, equipment, or the well itself. An open ended pressurizable vessel is provided that is sized and shaped to accommodate a substantial portion of downhole devices, such as a logging tool. The vessel includes a mating flange for coupling the open end to a reversibly sealable wellhead fixture. A pressure can be equalized between an internal cavity of the pressurizable vessel and the wellbore. Once the pressure has been equalized, a channel can be opened between the pressurizable vessel and the wellbore, allowing for substantially unhindered transfer of the downhole device in a preferred direction, either into or out of the well.

One embodiment of the invention relates to a process for transferring a downhole device through a reversibly sealable wellhead fixture capping a well under pressure. The process includes providing a pressurizable vessel having an open end and defining a cavity therein configured to retain the downhole device, such as a logging tool. The open end of the pressurizable vessel is attached to the reversibly sealable wellhead fixture. Pressures are equalized between the cavity and the wellbore. Having established a substantial pressure equilibrium, the reversibly sealable wellhead fixture is opened, providing substantially unhindered access between the cavity and the wellbore. The downhole device can be transferred swiftly and unencumbered between the cavity of the pressurizable vessel and the wellbore. After such transfer, the reversibly sealable wellhead fixture can be re-sealed with respect to the pressurizable vessel. The pressurizable vessel can be removed from the open end of the well under pressure. In some embodiments, an elevated pressure within the cavity of the pressurizable vessel is returned to atmospheric pressure either before or after transfer of the downhole device.

Another embodiment of the invention relates to a system for transferring downhole devices across an open end of a well under pressure. The system includes a pressurizable vessel defining an interior cavity open at one end and configured to retain a downhole device, such as a logging tool. The system also includes an operable seal positioned in relation to the open end of the cavity and operable to seal the cavity against an external pressure. The external pressure can be an elevated pressure within a wellbore of the well under pressure. The pressurizable vessel includes a mounting flange configured to mount the pressurizable vessel to a reversibly sealable wellhead fixture capping the well under pressure. A thrust unit can be disposed within the cavity and configured to transfer the downhole device between the cavity and the wellbore through the reversibly sealable wellhead fixture. In at least some embodiments, a pressure within the pressurizable vessel is equalized to an elevated pressure of the well under pressure, such that transfer of the downhole device can be accomplishable at the elevated pressure, allowing any safety seals in the wellhead fixture to be opened unhindered transfer of such hardware.

Yet another embodiment of the invention relates to a downhole deployment cartridge, including a pressurizable vessel defining a cavity open at one end pre-loaded with a downhole device, such as a logging tool. The pressurizable vessel includes an operable seal positioned in relation to the open end of the cavity and configurable between open and closed positions. The operable seal seals the cavity against a pressure when configured in the closed position. The pressurizable vessel also includes a mounting flange disposed relative to the open end of the cavity, configured to mount the pressurizable vessel to an open end of a well under pressure. An actuator disposed within the cavity is configured to transfer the downhole device between the cavity and the open end of the well under pressure. Thus, transfer of the downhole device can be accomplishable in a pressurized environment, allowing any safety seals in the wellhead fixture to be opened for unhindered transfer of such hardware.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF THE PREFERRED EMBODIMENTS

An open-ended chamber is provided, mountable to a wellhead fixture with facilities to equalize a pressure within the chamber to an elevated pressure of the wellbore of a well under pressure. The chamber is sized and shaped to accept at least a substantial portion of any downhole device, such as a logging tool. Having equalized pressure in the open-ended chamber to that of the wellbore, any of the safety sealing features of the wellhead fixture are unnecessary, and can be opened to allow unhindered transfer of such logging tools between the wellbore and the chamber without snubbing. Once a transfer has been completed, the wellhead fixture can be re-sealed either against the logging tool, a coil tube, or drill string, or completely sealed, and the chamber removed to resume normal operations.

The open-ended chamber need only be long enough for the longest tool of a tool string, because each tool can be inserted individually with interconnections performed at the wellhead fixture. Accordingly, there is no need for a separate rig or derrick, since the tools are supported in the chamber. In some embodiments, support equipment can be provided to manipulate the tools and chamber, such as a crane or robotic arm.

Figure 1:
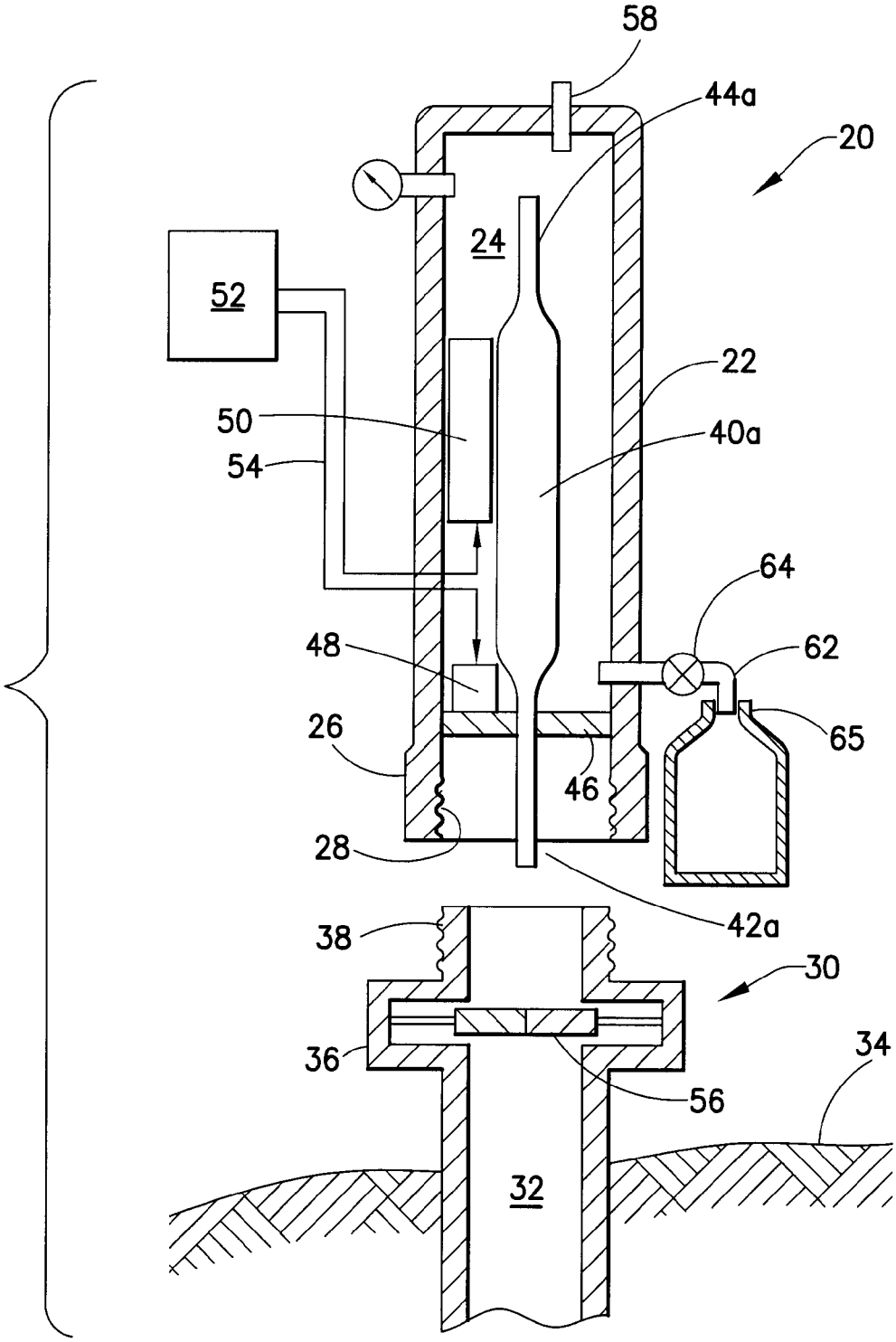
FIG. 1 is a sectional schematic view of one embodiment of a pressure-compensating wellbore deployment system according to the present invention.

FIG. 1 illustrates a wellbore deployment system 20 configured for inserting and removing downhole devices from an open end of a well under pressure. The wellbore displacement system 20 includes a pressurizable vessel 22 defining an internal cavity 24 open at one end 26. The cavity 24 is sized and shaped to accommodate a downhole device, such as a logging tool 40*a*. The pressurizable vessel 22 can be an elongated cylindrical container as shown in cross-section. The open end 26 includes a mating feature such as an internal thread 28 for coupling the pressurizable vessel 22 to an open end of a well 30. The downhole devices can be cylindrical, with varying cross sections. They can also have other geometric configurations, such as prismatic; cylindrical, right or inclined; or truncated pyramidal.

The well 30 includes a well head or casing above surface level onto which wellhead fixture 36 is mounted, such as a blow-out preventor (BOP) or so-called Christmas tree structure. In the exemplary embodiment, the wellhead fixture is a BOP 36 that provides access to the wellbore 32 and includes at least one controllable pressure barrier 56. The controllable pressure barrier 56 can include a seal or ram-type BOP. Such pressure barriers 56 can be configured with packer elements that are adapted to form a seal around a cylindrical structure inserted within the BOP 36. The packer elements can include annular elastomeric elements that are driven inward into the bore 32 by one or more pistons to form a sealing engagement with tubular members of a variety of diameters. This may include a pair of sealing members having semi-cylindrical concave faces that seal tightly against the tubular member of the selected diameter. An exemplary device including such controllable pressure barriers is described in U.S. Pat. No. 6,328,111. The wellhead fixture 36 also includes a mating coupling at a proximal end that is configured to form a fluid-tight seal against the pressurizable vessel mating coupling 28. For example, the wellhead fixture 36 includes an external male thread 38 around the external perimeter positioned to engage the internal female thread 28 of the pressurizable vessel 22.

In some embodiments, the wellbore deployment system 20 includes a reversibly-expandable seal 46 positioned towards the open end 26. The reversibly-expandable seal 46 can be a reversible seal 46 providing an annular seal between an internal wall of the cavity 24 and an outer surface (i.e., perimeter) of the downhole device 40*a*. For example, the reversible seal 46 can be configured as an iris positioned in a plane orthogonal to a central axis of the elongated cavity 24 and adapted to selectively close against an outer surface of the downhole device 40*a*.

Operation of the reversible seal 46 can be accomplished using a reversible-seal actuator 48. The reversible-seal actuator 48 is preferably controlled from a remote controller 52 located external to the cavity 24. As shown, the remote controller 52 can be interconnected to the reversible seal actuator 48 by control leads 54. These control leads 54 can be electrically conductive wires or a waveguide, such as an optical fiber. In some embodiments, the remote controller 52 communicates with the reversible seal actuator 48 through a wireless link. An operator, or operating program, communicates with the reversible-seal actuator 48 through the control leads 54. The remote controller 52 sends one or more commands to the reversible-seal actuator 48 causing the actuator 48 to open and close.

The wellbore deployment system 20 also includes a thrust unit 50 configured to translate the downhole device 40*a* in at least one direction along the elongated axis of the cavity 24. For example, the thrust unit 50 can push a logging tool into the wellhead fixture 36. Alternatively or in addition, the thrust unit can pull a logging tool up from the wellhead fixture 36. The thrust unit 50 is also in communication with a remote controller, which can be the same remote controller 52. Preferably the reversible-seal actuator 48 and the thrust unit 50 cooperate such that the reversible seal 46 is adjusted to an appropriate dimension by the reversible-seal actuator 48 allowing the thrust unit 50 to insert or remove the downhole device 40*a* from the well 30.

In some embodiments, the pressurizable vessel 22 includes a pressure gauge 60 providing an external indication of a pressure within the cavity 24. Alternatively or in addition, the pressurizable vessel 22 includes at least one valve providing selective external access to the cavity 24. For example, the valve 58 can be a bleeder valve configured to allow air to escape as pressure is increased within the cavity. A bleeder valve 58 allows air to escape from the cavity 24 as well fluids or compensating fluid is inserted into the cavity 24 to equalize pressure with wellbore pressure. In some embodiments, the pressurizable vessel 22 also includes a safety valve configured to release pressure above a maximum pressure threshold. Alternatively or in addition, the pressurizable vessel 22 also includes a vent to facilitate draining or purging a fluid from the cavity 24.

In some embodiments, the pressurizable vessel 22 includes a fluid port 62 in fluid communication with the cavity 24. Preferably the fluid port 62 includes a valve 64 operable to selectively open and close the fluid port 62. In some embodiments, a container 65 is provided at atmospheric pressure and configured to receive fluid drained from cavity 24 through the fluid port 62.

Figure 2A:
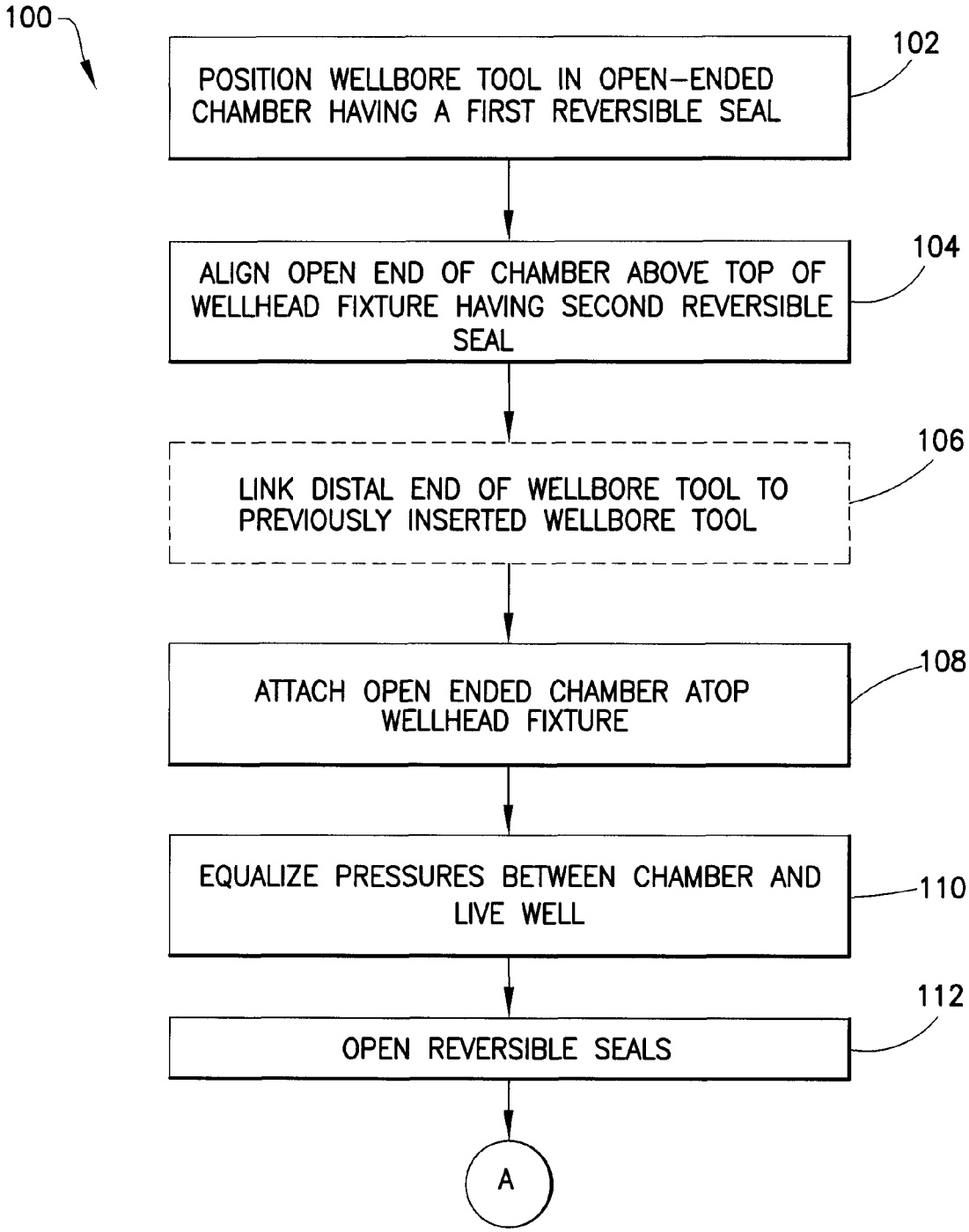
FIG. 2A and FIG. 2B provide a flow diagram illustrating the overall procedure for inserting a tool into a well according to the present invention.
Figure 2B:
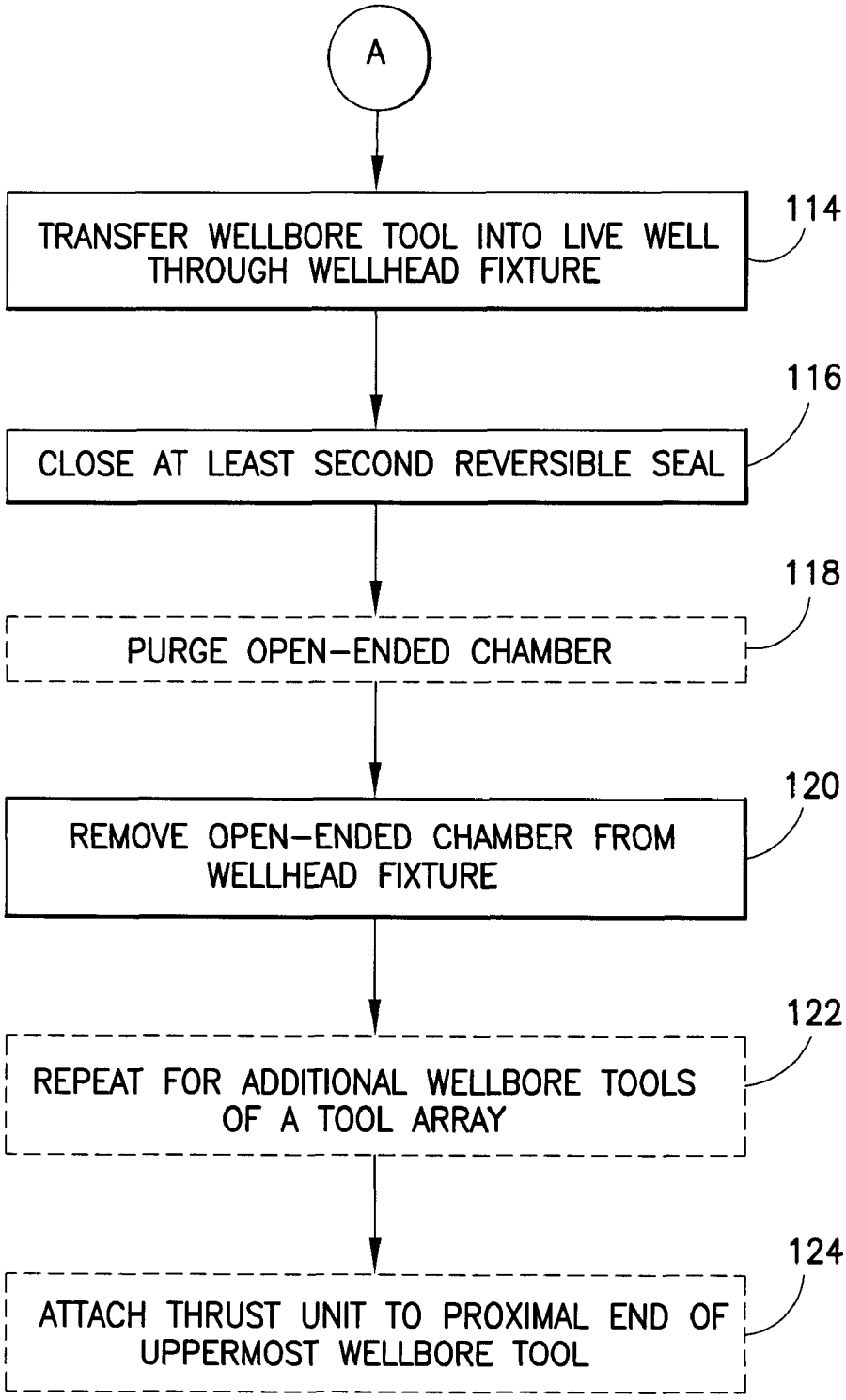

FIG. 2A and FIG. 2B together illustrate exemplary procedure 100 for inserting a wellbore tool into a well that may be under pressure. First, the downhole device, or tool, is positioned at least partially into an open-ended pressurizable chamber having a reversible seal at one end (102). In some embodiments, tools are inserted into the open-ended pressurizable chamber at the job site. In other embodiments, the open-ended chamber is provided in a cartridge configuration together with a tool already inserted therein. With the tool inserted into the chamber and accessible from the open end, the open end of the chamber is positioned above the top of the wellhead fixture (104). Preferably, a distal portion of the tool extends beyond the open end of the chamber allowing access to the distal end of the tool while at least a portion of the tool is still positioned within the chamber. The partially exposed distal end of the tool can be inserted into an opening of the wellhead fixture as may be accomplished for single tool deployment, or for the first tool of a tool array. When the tool being inserted is the second or subsequent tool of an array of tools, the partially exposed distal end of the tool can be linked to a proximal end of a previously inserted tool partially exposed or at least accessible from the top of the wellhead fixture (106).

The open end of the chamber aligned above the wellhead fixture is next brought into engagement with the wellhead fixture and attached thereto (108). In some embodiments, the open end of the chamber includes a mounting flange such as a threaded portion configured to mate with a corresponding mounting flange, i.e., threaded portion of the wellhead fixture. When mated, the open-ended chamber forms a pressure-resistant fluid-tight seal with the wellhead fixture.

Next, the pressure between the chamber and the well is equalized (110). The well includes a wellbore in communication with an underground formation that may exist at a pressure elevated above that of atmospheric pressure. In some instances the pressure at the surface of the wellbore is also above atmospheric pressure. It is common for the wellhead fixtures, such as blow-out preventors (BOP) or Christmas tree structures, to include at least one reversible pressure seal. This reversible pressure seal can be used to isolate an elevated wellbore pressure from atmospheric pressure. When operating at an elevated pressure, a gas or a fluid can be inserted into the chamber affixed to the wellhead fixture to increase the pressure within the cavity of the chamber. The chamber can include a pressure gauge for monitoring pressure within the cavity. A pressure gauge may also be provided within the wellhead fixture to provide an indication of the pressure within the wellbore. Insertion of the fluid can be accomplished through the fluid port 62 (FIG. 1) which includes a valve 64 that can be closed to hold the pressure within the cavity to a pressure value substantially equal to that within the wellbore. By equalizing the pressure, a controlled environment can be established within the cavity of the pressurizable vessel. Preferably, the compensating fluid is provided having a density less than that of a fluid within the wellbore such that when the cavity of the pressurizable vessel is opened to the wellbore, the wellbore fluid is prevented from rising into the cavity and potentially interfering with the operation of any equipment included therein.

Having substantially equalized pressures, the one or more pressure barriers in each of the wellhead fixture and wellbore deployment system can be opened (112). Having established a controlled pressure environment and having opened the pressure barriers, the wellbore tool can be inserted through an opening of the wellhead fixture at least partially into the wellbore (114). Having transferred the tool to a preferred position within the wellbore, a second reversible seal provided in the wellbore fixture can be closed (116), forming a fluid-tight seal about an external portion of the tool. Thus, the tool is at least partially inserted within the wellbore with a proximal end of the tool accessible from a top portion of the wellhead fixture.

The open-ended chamber can be removed from the wellhead fixture (120). In some embodiments, the open-ended chamber is purged to remove the gas or fluid provided in an earlier step to return pressure within the cavity to atmospheric pressure (118). A purging process can be accomplished by opening a valve 64 (FIG. 1) allowing the gas or fluid within the cavity to exit through the fluid port 62. In some embodiments, the pressurizable vessel 22 includes a vent 58 facilitating drainage of a fluid within the cavity. Such a purging process can be accomplished before the pressurizable vessel is removed from the wellhead fixture (120). Alternatively, the purging can be accomplished after the pressurizable vessel has been removed from the top of the wellhead fixture. In this instance, a reversible seal provided near the open end of the pressurizable vessel is preferably closed, thereby containing any fluid in the cavity at the elevated pressure. This allows for removal of a pressurized vessel that can be purged later.

The insertion process can be repeated for one or more additional wellbore tools of a tool array (122). After insertion of the last tool of a tool array, a thrust unit can be attached to a proximal end of the uppermost wellbore tool, which remains at least partially exposed and accessible at the wellhead fixture (124).

Figure 3A:
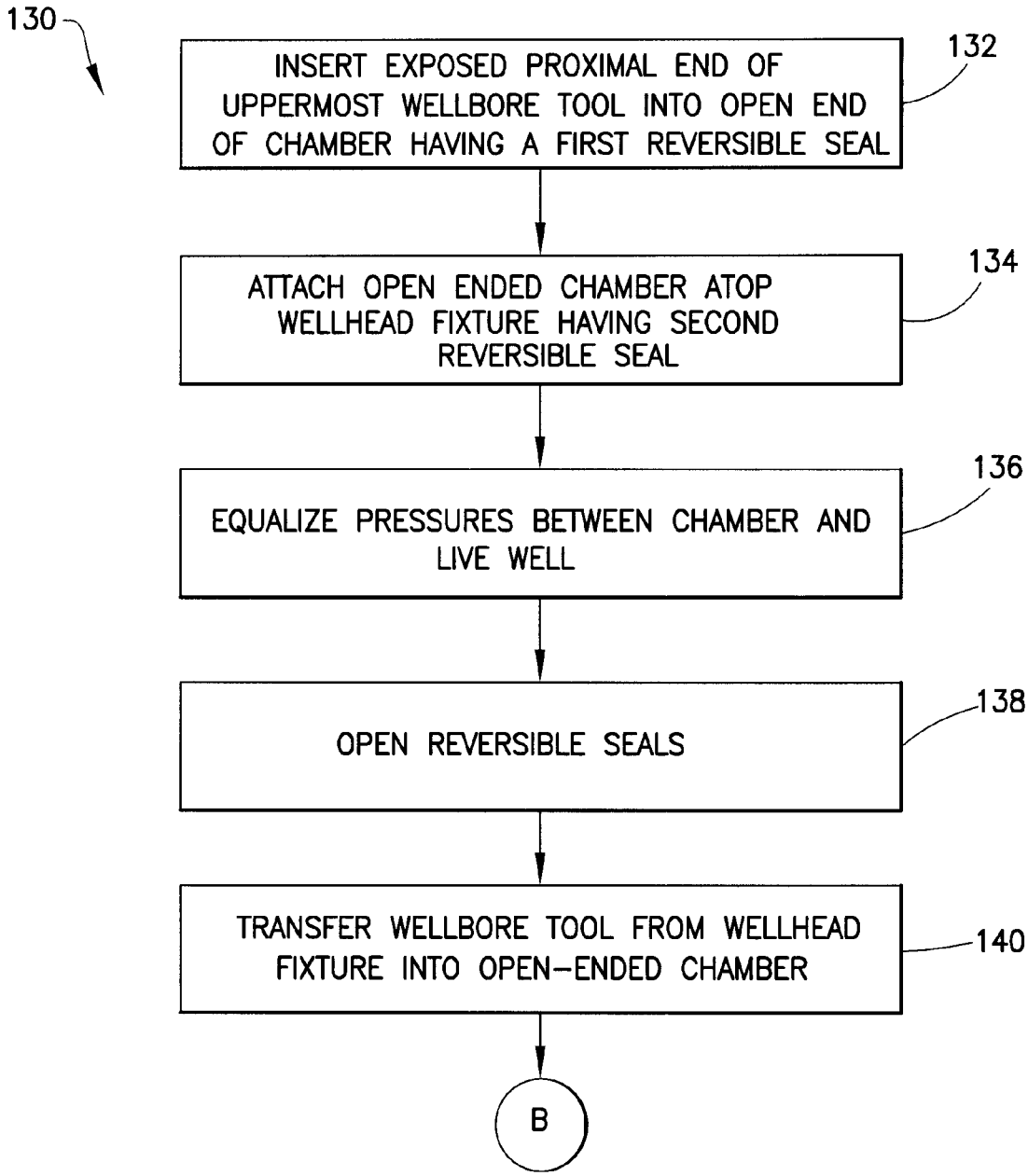
FIG. 3A and FIG. 3B provide a flow diagram illustrating the overall procedure for extracting a tool from a well according to the present invention.
Figure 3B:
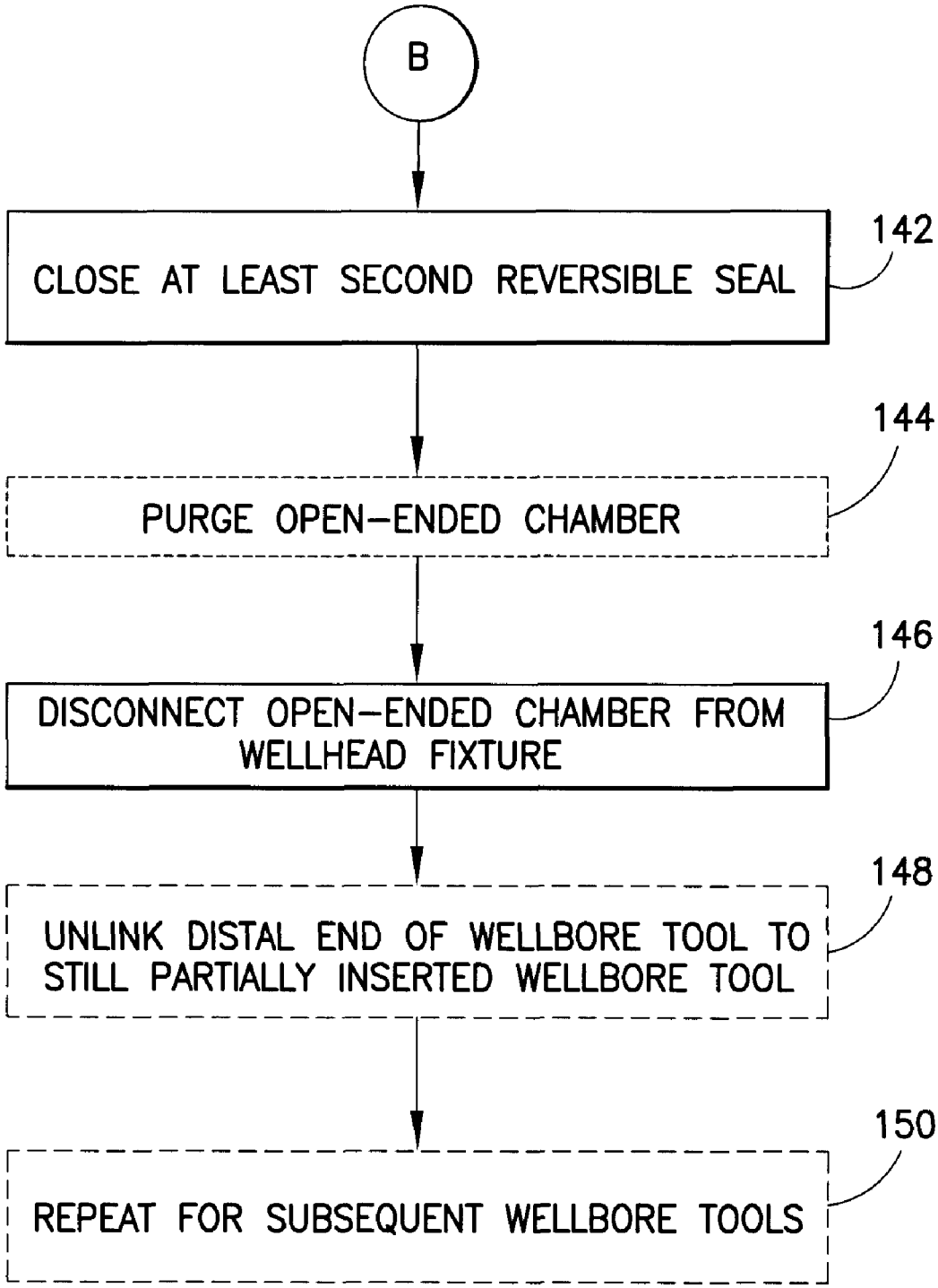

FIG. 3A and FIG. 3B together illustrate an exemplary process 130 for removing a tool from a well. Typically, a proximal end of a tool at least partially within the hole will be exposed or accessible from an open end of the wellhead fixture prior to its removal from the wellbore. An elevated pressure within the well can be maintained from atmospheric pressure by a controllable pressure barrier forming a fluid-tight seal between the interior of the wellbore and an external surface of the tool. Such a configuration can be obtained using a reversible seal of the wellhead fixture against a proximal end of the tool. An open-ended pressurizable vessel is aligned above an opening of the wellhead fixture. A reversibly-expandable seal positioned near the open end of the pressurizable vessel can be at least partially opened, the pressure within the cavity being atmospheric pressure. The open end of the pressurizable vessel is lowered to approach the open end of the wellbore fixture and the proximal end of the tool is inserted into an opening of the partially open reversibly-expandable seal (132). The mounting flange of the pressurizable vessel is attached to a corresponding mounting flange of the wellbore fixture forming a fluid-tight seal therebetween (134). Next, a pressure within the cavity is equalized with pressure within the well (136). Pressure equalization can be accomplished using, for example, any of the methods described herein such as inserting into the cavity a gas or liquid such as a compensating fluid, monitoring the pressure at a pressure gauge until the pressures are equal, and then sealing the cavity to maintain the established pressure. In some embodiments, the reversibly-expandable seal provided near the open end of the pressurizable vessel can be closed against an outer surface of the proximal end of the tool, forming a fluid-tight seal. Once the pressures have been equalized, the one or more pressure barriers are opened providing open access from the wellbore to the cavity of the pressurizable vessel (138). An axial translator positioned within the cavity can be attached or at least brought into frictional engagement with the exposed proximal end of the tool prior to engagement such that the axial translator when operated pulls the tool into the cavity thereby extracting it from the wellbore (140). A second pressure barrier provided within the wellhead fixture is closed, sealing the wellbore from the cavity (142).

The cavity now isolated from the wellbore can be purged as described in relation to FIG. 2A and FIG. 2B to return pressure within the cavity to atmospheric pressure (144). Next, the open-ended chamber can be removed from the wellhead fixture (146). For applications in which the extracted tool is connected to further tools in a tool array, the disconnected open-ended chamber is held slightly above the opening of the wellhead fixture to allow access to an interconnection between a distal end of the extracted tool and a proximal end of the still partially-inserted tool of the array. Such an interconnection between tools is unlinked (148) allowing the chamber including the extracted tool to be removed from above the wellhead fixture. The removal process can be repeated for subsequent wellbore tools of a wellbore tool array (150).

Figure 4:
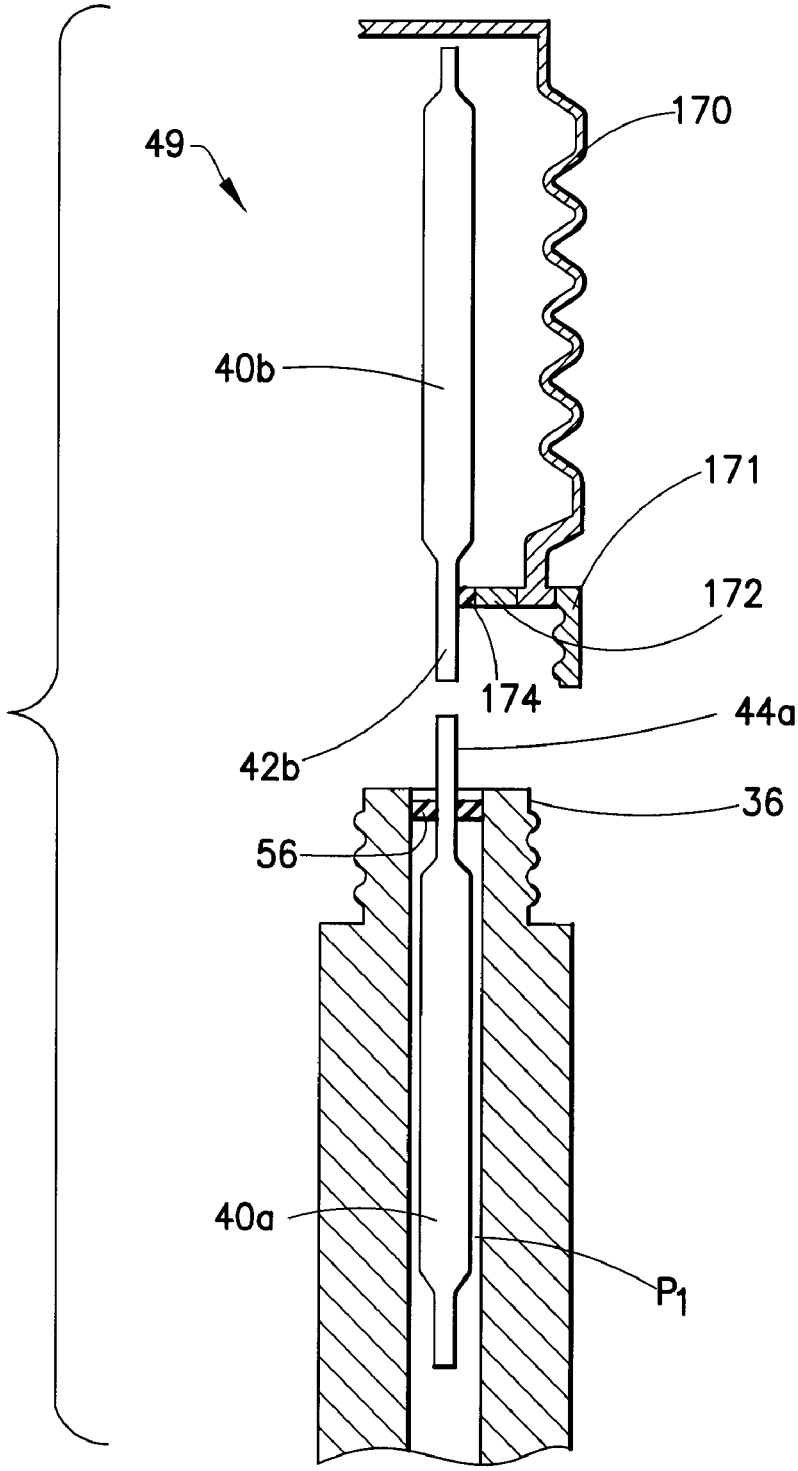
FIG. 4 is a sectional schematic view of an alternative embodiment of a pressure-compensating wellbore deployment system according to the present invention.

FIG. 4 illustrates transfer of a proximal tool 40*b* of a multi-tool array. As shown, the proximal tool 40*b* is contained within a pressurizable vessel 170 defining a cavity open at one end 171. A reversible seal 172 is included toward the open end 171 and configured to form a reversible pressure resistant seal between a wall of the cavity and an outer surface of the proximal tool 40*b*. The reversible seal can include a deployable structure fitted with a compliant sealing member 174 positioned to engage the outer surface of the distal end 42*b* of the tool.

The pressurizable vessel 170 is shown slightly above an opening of the wellhead fixture 36 just after the two tools 40*a*, 40*b* have been unlinked in an extraction process, or just prior to the tools 40*a*, 40*b* being joined in an insertion process. A lower or distal tool 40*a* of the array of tools remains in the wellbore with a proximal end 44*a* of the distal tool 40*a* being partially exposed above an opening of the wellhead fixture 36. Also shown is a pressure barrier 56 positioned between the proximal end 44*a* of the distal tool 40*a* and an interior surface of the wellhead fixture 36 to isolate an elevated well pressure $P_1$ from atmospheric pressure without the pressurizable vessel 170 being connected. In some embodiments, the pressurizable vessel 170 includes at least a portion of a wall which is compliant.

Figure 5:
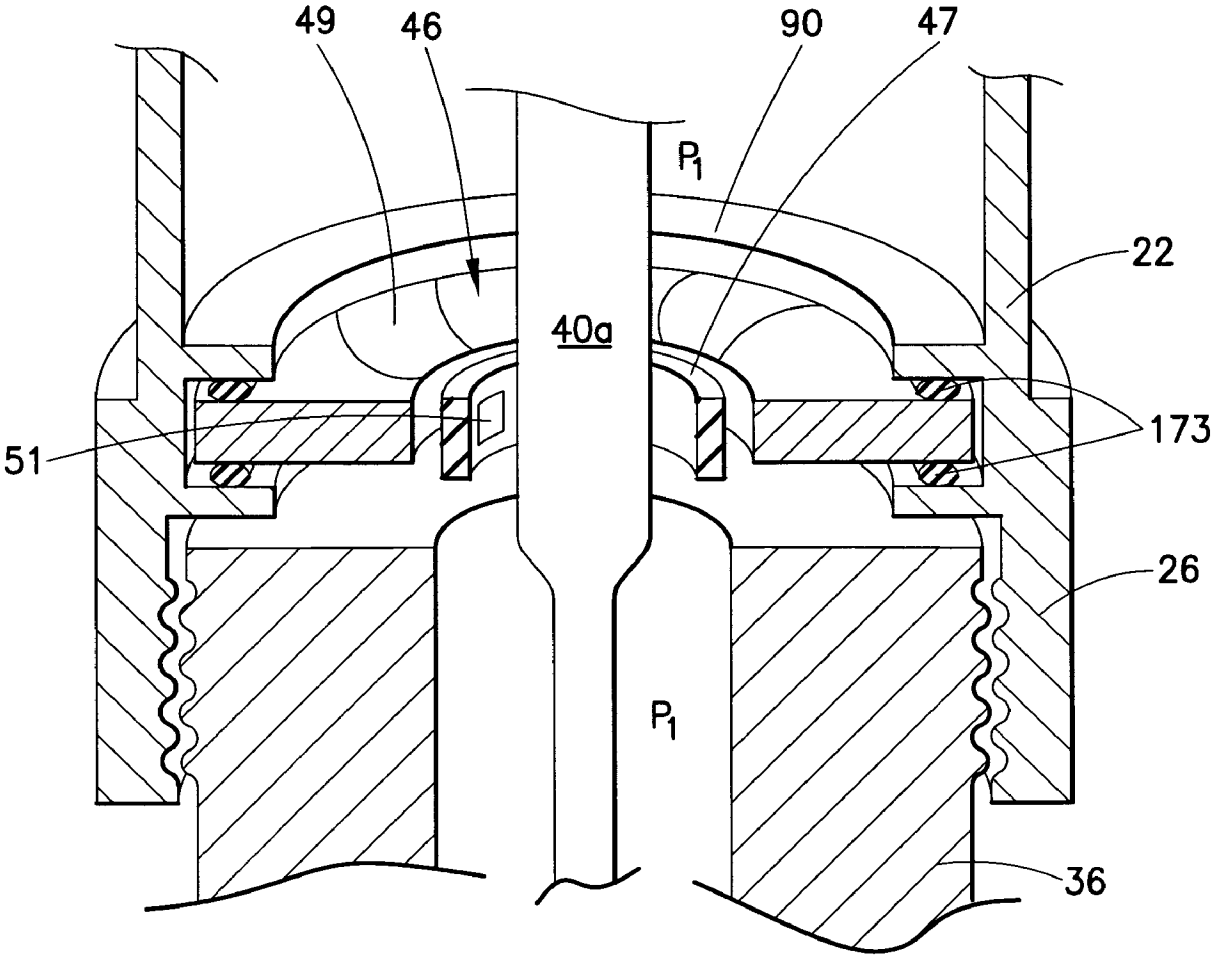
FIG. 5 is a sectional schematic view illustrating in more detail an embodiment of a reversibly expandable seal according to the present invention.

A more detailed view of a reversible seal 46 is provided in the sectional view of FIG. 5. In some embodiments, the reversible seal 46 is formed using a dynamic-sealing, deployable structure 49. The deployable structure 49 includes at least three pivotally-joined double lever assemblies forming an enclosed mechanical linkage. Such reversibly-expandable structures are described in more detail in U.S. patent application Ser. No. 11/962,256, entitled "System and Methods for Actuating Reversibly Expandable Structures," filed on Dec. 21, 2007, incorporated herein by reference in its entirety. Although the exemplary embodiments are directed to cylindrical applications, reversibly-expandable structures can be provided having internal apertures shaped to accommodate polygonal tools (e.g., rectangular), ellipsoidal tools, and complex-shaped tools having perimeters with a combination of linear and curvilinear shapes.

In the illustrative embodiment, this enclosed linkage 49 forms an annular structure disposed between an interior surface of the pressurizable vessel and an outer surface of a tool 40*a* positioned therein. An internal aperture of the annular enclosed mechanical linkage 49 is configured to expand or contract when one or more of the double lever assemblies are manipulated. In the illustrative embodiment, an outer perimeter of the annular structure remains in sealable contact with the inner wall of the pressurizable vessel while an inner perimeter of the annular structure is allowed to vary between maximum and minimum diameters according to adjustment of the mechanical linkage. Thus, the annular structure when engaging the tool 40*a* with its inner perimeter forms a seal between the inner wall of the cavity and the outer surface of the tool. In some embodiments, a sealing member 47 is inserted between the inner perimeter of the annular structure 49 and the outer surface of the tool 40*a*. For example, an elastomeric material 47 can be applied or fixed to the inner perimeter of the annular structure 49 such that when the inner perimeter is enclosed to engage the outer surface of the tool 40*a*, the elastomeric material 47 is entrapped between the inner perimeter and the tool 40*a* forming a fluid-tight seal. In some embodiments, the elastomeric material 47 is segmented around the inner perimeter to provide a continuous seal when closed, but allowing substantial expansion without damage to the elastomeric material 47.

A pressure sensor 51 such as a strain gauge can be positioned between the inner perimeter and the outer surface of the tool 40*a* as shown. For example, the pressure sensor 51 could be impregnated within the elastomeric material and configured to sense a strain indicative of the pressure exerted between the inner perimeter of the annular structure 49 when engaging the outer surface of the tool 40*a*. Alternatively or in addition, the pressure sensor 51 can be included between the outer perimeter of the annular structure 49 and the interior surface of the pressurizable vessel again sensing pressure exerted when the reversible seal 46 is adjusted to form a seal. One or more pressure sensors 51 can be coupled to an external pressure monitor (not shown) providing the user with an indication of the pressure exerted. More preferably the one or more pressure sensors 51 can be connected to a controller in a feedback control loop configuration such that the controller adjusts the reversible seal 46 in response to monitored output pressure provided by the pressure sensor 51. The controller adjusts the inner perimeter of the reversible seal 46 until a predetermined sealing pressure is obtained. Once the desired sealing pressure is obtained, further adjustment of the annular structure terminates.

In some embodiments, one or more sealing members are provided along the outer edge of the annular structure and the inner surface of the pressurizable vessel. As shown, these may include one or more elastomeric seals or o-rings 173 disposed between the outer perimeter of the deployable structure and a flange 90 coupled to the inner wall of the pressurizable vessel 22.

Figure 6:
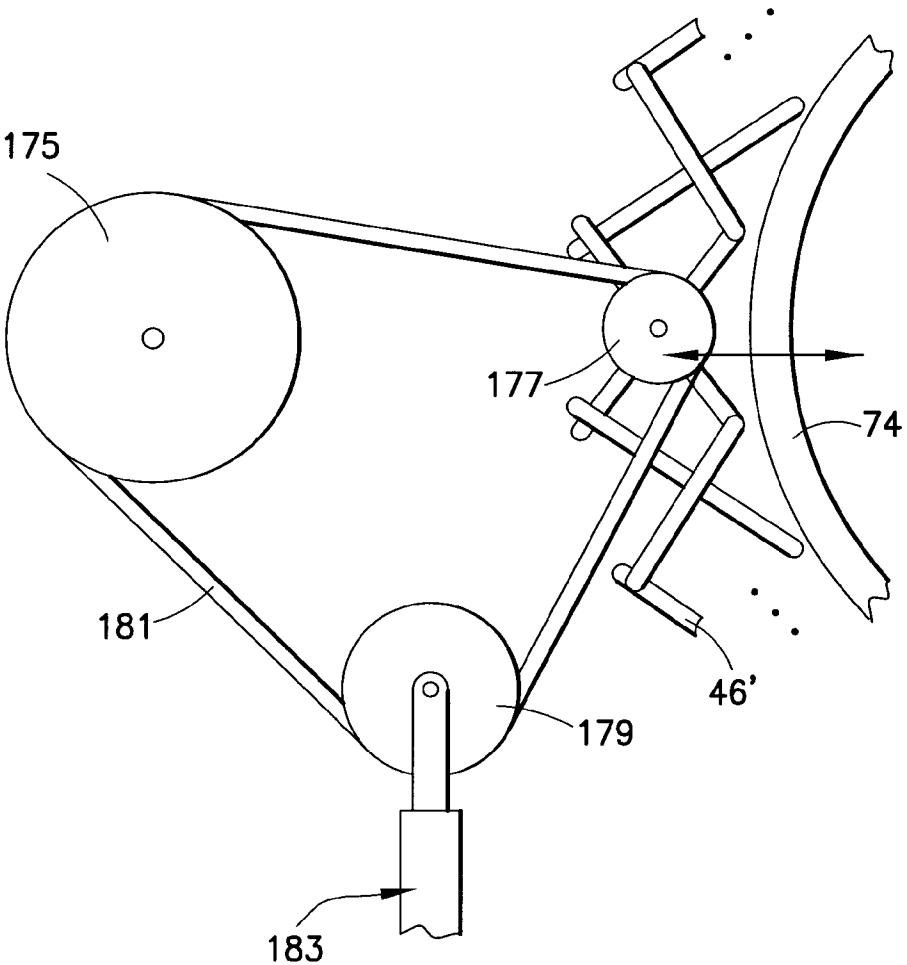
FIG. 6 is a planar view of an embodiment of a reversible seal actuator according to the present invention.

FIG. 6 illustrates one embodiment of an actuator configured to manipulate one of the joined double lever assemblies of the mechanical linkage 49 of the reversible seal 46', thereby causing the reversible seal 46' to change its dimensions. The exemplary embodiment includes a driving wheel 175 providing a torque positioned adjacent to a driven wheel 177 coupled to one of the double lever assemblies. When the driven wheel 177 is rotated, it causes a corresponding rotation of the double lever assembly through rotation of the driven wheel 177. The driving wheel 175 and driven wheel 177 can be pulleys about which a drive belt 181 is coupled. The driving wheel 175 can be connected to an electric motor providing the necessary torque. Rotation of the driving wheel 175 rotates the drive belt 181 which also rotates the driven wheel 177. The driven wheel 177 typically moves in relation to the driving wheel by expansion and contraction of the reversible seal 46. In the exemplary embodiment, the driven wheel 177 moves along a straight line path between the centers of the driving wheel 175 and the driven wheel 177. In some embodiments, a third wheel 179 is also provided in communication with the drive belt 181 such that the center of the third wheel 179 is displaceable in a direction non-parallel to the line joining the driving wheel 175 and the driven wheel 177 as illustrated. Preferably, the third wheel 179 is rotatably coupled to a device that displaces the third wheel with respect to the driving wheel 175 and the driven wheel 177 to maintain tension of the belt 181 when the driven wheel 177 moves toward or away from the driving wheel. In some embodiments, the driving wheel 175, the driven wheel 177, and the third wheel 179 can be replaced by cogs and the belt 181 replaced by a chain, to the same effect.

Illustrated in FIG. 7A through FIG. 7D is an exemplary installation of a downhole device such as a logging tool 40*a* into an open end of the wellhead fixture 36. The exemplary embodiment of the wellbore deployment system 20' includes a rotating wheel actuator 180 including a spool 182 onto which one end of a tension line, such as a rope, chain, or wire 184 is at least partially wound and fastened to. An opposite end of the wire 184 is coupled to a proximal end of the logging tool 40*a* at least partially contained within an internal cavity of the pressurizable vessel 22'. Coupling of the wire 184 to the logging tool 40*a* can be accomplished with a toolhead coupler 186. The wellbore deployment system 20' can also include one or more pulleys 188', 188" (generally 188). In the exemplary embodiment, two pulleys are attached to the internal cavity of the pressurizable vessel 22' opposite to the open end 26'. One of the pulleys 188" is aligned substantially above the proximal end of the logging tool 40*a*. The second pulley 188' may be aligned substantially above the rotating wheel actuator 180. The wire 184 can be routed from the rotating wheel actuator 180 through the two pulleys 188 and attached to the proximal end of the logging tool 40*a* using the toolhead coupler 186.

The wellbore deployment system 20' also includes a reversible seal including a deployable structure 176 having a compliant internal seal 178 positioned to engage an exterior surface of a distal end 42*a* of the logging tool 40*a*. A reversible seal actuator 48' is in communication with the deployable structure 176 for manipulating the deployable structure 176 between open and closed positions. As shown, the deployable structure 176 can be closed against the distal end 42*a* of the logging tool 40*a* forming a pressure-tight seal such that the internal cavity of the pressurizable vessel 22' can be precharged with a gas or fluid to an elevated pressure comparable to an anticipated pressure of the well.

Figure 7B:
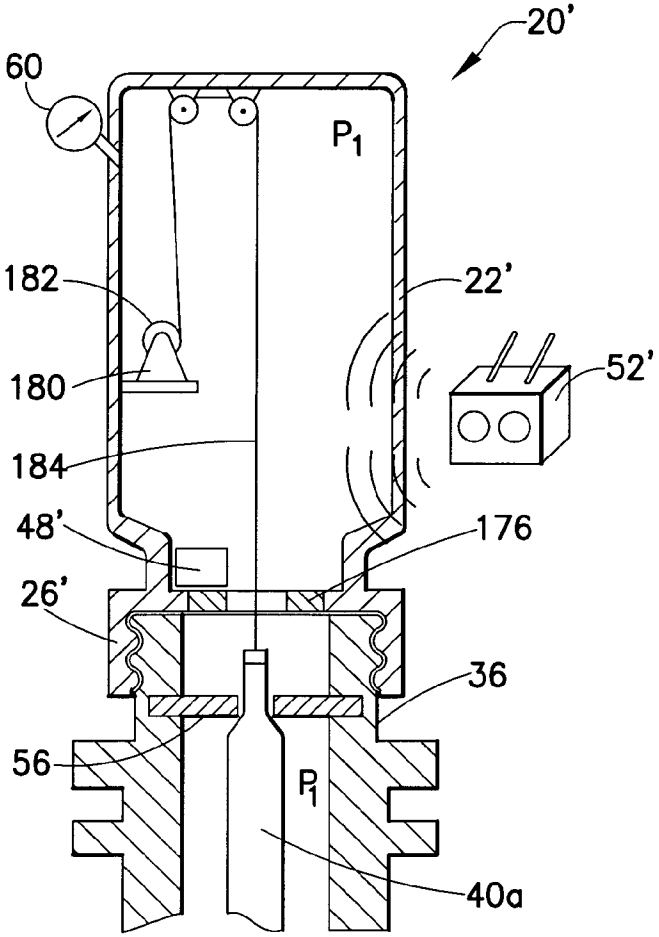
FIG. 7A through FIG. 7D together illustrate insertion of a tool into a well using an embodiment of a pressure-compensating wellbore deployment system including an embodiment of a reel-and-line axial translation actuator according to the present invention.
Figure 7A:
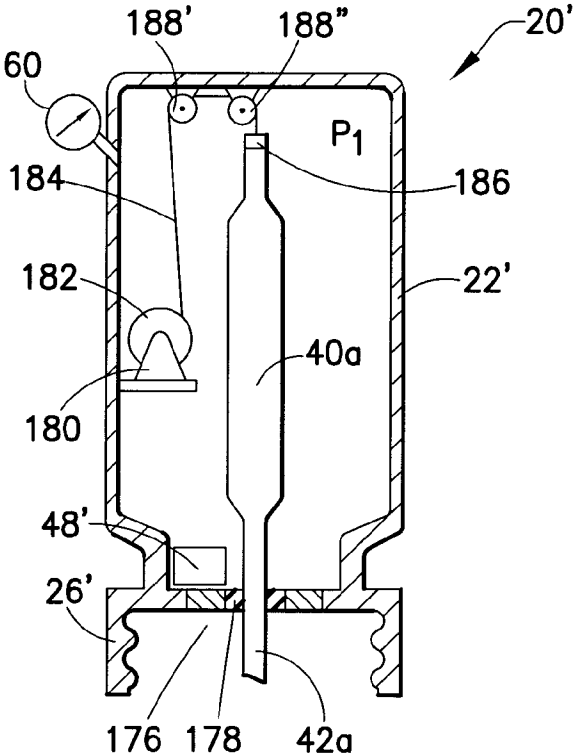

Referring now to FIG. 7B, the open end 26' of the pressurizable vessel 22' is attached to the open end of the wellhead fixture 36 forming a pressure-tight seal therebetween. Having substantially equalized a first pressure within the internal cavity of the pressurizable vessel 22' and the pressure within the well, the deployable structure 176 can be opened releasing the distal end 42*a* (FIG. 7A) of the logging tool 40*a*. Typically, the wellhead fixture 36 includes at least one reversible pressure seal 56 configured to form a pressure-tight seal against an exterior surface of the logging tool 40*a*. Having the pressure substantially equalized between the well and the chamber, the at least one reversible seal 56 of the wellhead fixture 36 can be opened allowing translation of the logging tool 40*a* through the open end 26' of the pressurizable vessel 22' and into an open end of the wellhead fixture 36. Such translation can be accomplished by relying upon gravity acting upon the mass of the logging tool 40*a*. For example, the rotating wheel attenuator 180 can be actuated to rotate in a direction allowing the wire 184 to extend through the pulleys 188, with the wire being drawn from the reel 182 by the weight of the logging tool 40*a*.

Figure 7D:
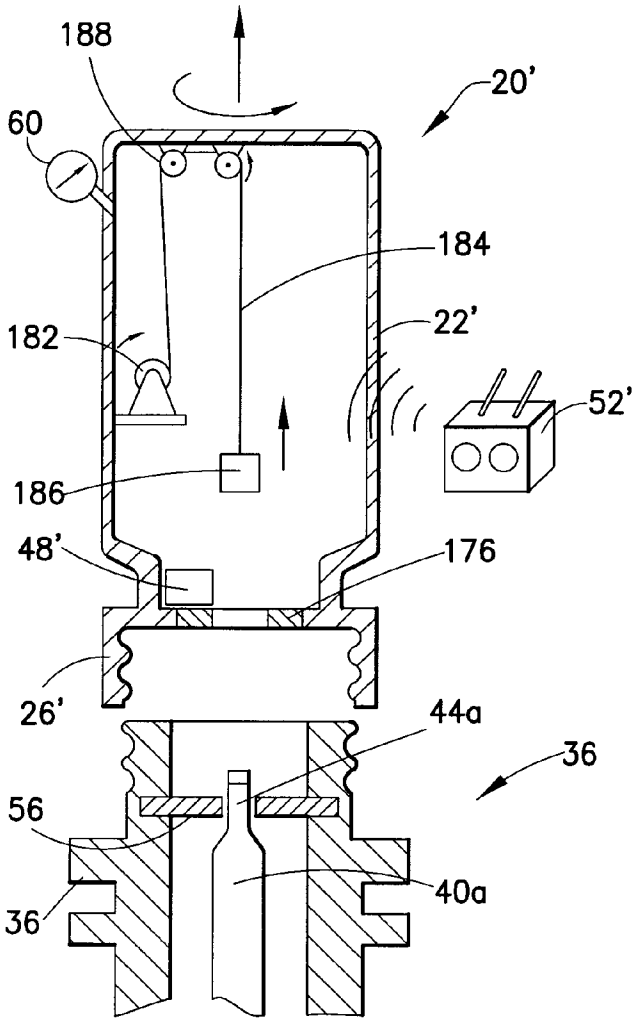
Figure 7C:
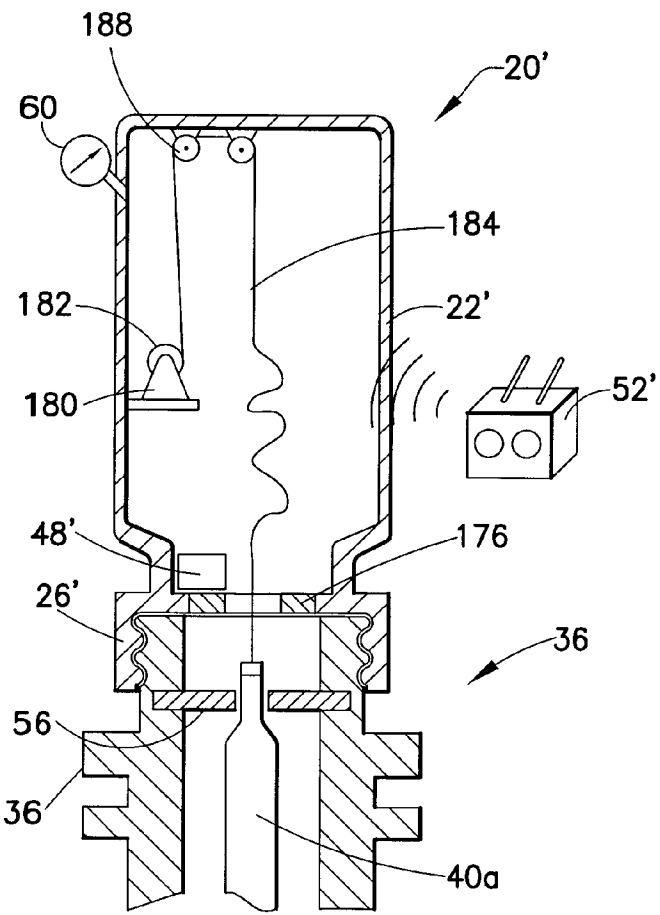

Referring now to FIG. 7C, the reversible seal 56 of the wellhead fixture 36 is closed upon a proximal end 42*b* of the logging tool 40*a* forming a pressure-tight seal against an outer surface of the logging tool 40*a*. This seal provides a barrier between an elevated pressure of the well and a pressure within an internal cavity of the pressurizable vessel 22'. The rotating wheel actuator 180 can be operated to release an additional amount of wire 184 from the spool 182 or simply left in an freely spinnable configuration, allowing additional wire 184 to be wound off of the spool 182. At this point, the pressure within the internal cavity of the pressurizable vessel 22' can be purged to return it to atmospheric pressure as described above in relation to FIG. 1. In some embodiments, actuation of the rotating wheel actuator 180 can be accomplished using a remote control 52'. Alternatively or in addition, actuation of a reversible seal actuator 48' can also be accomplished using the remote control 52'. A single remote control 52' having one or more channels can be used to control one or more of the actuators 48, 180 with each actuator 48, 180 operable by a respective channel.

As illustrated in FIG. 7D, the open end 26' of the pressurizable vessel 22' is removed from an open end of the wellhead fixture 30' as shown. With sufficient slack provided in the wire 184 or allowing the spool 182 to rotate to allow additional wire 184 to roll off of the spool 182, the wire 184 will remain attached to a proximal end of the logging tool 40*a*. The pressurizable vessel 22' can be held at a position above the open end of the wellhead fixture, for example, by a crane or robotic system, to allow access by an operator to disengage the toolhead coupler 186 from the proximal end 44*a* of the logging tool 40*a*. At this point, the rotating wheel actuator 180 can be controlled to wind the wire 184 at least partially back onto the spool 182 thereby lifting the toolhead coupler 186 into the internal cavity of the pressurizable vessel 22'. At this point, the pressurizable vessel 22' can be removed from above the open end of the wellhead fixture 36, allowing access to the proximal end 44*a* of the logging tool 40*a*. Such access can be used to apply a thrust unit such as a coil tubing unit (not shown) to the logging tool 40*a* or, in some embodiments, to insert an additional logging tool using a similar procedure thereby forming a logging tool array.

Figure 8:
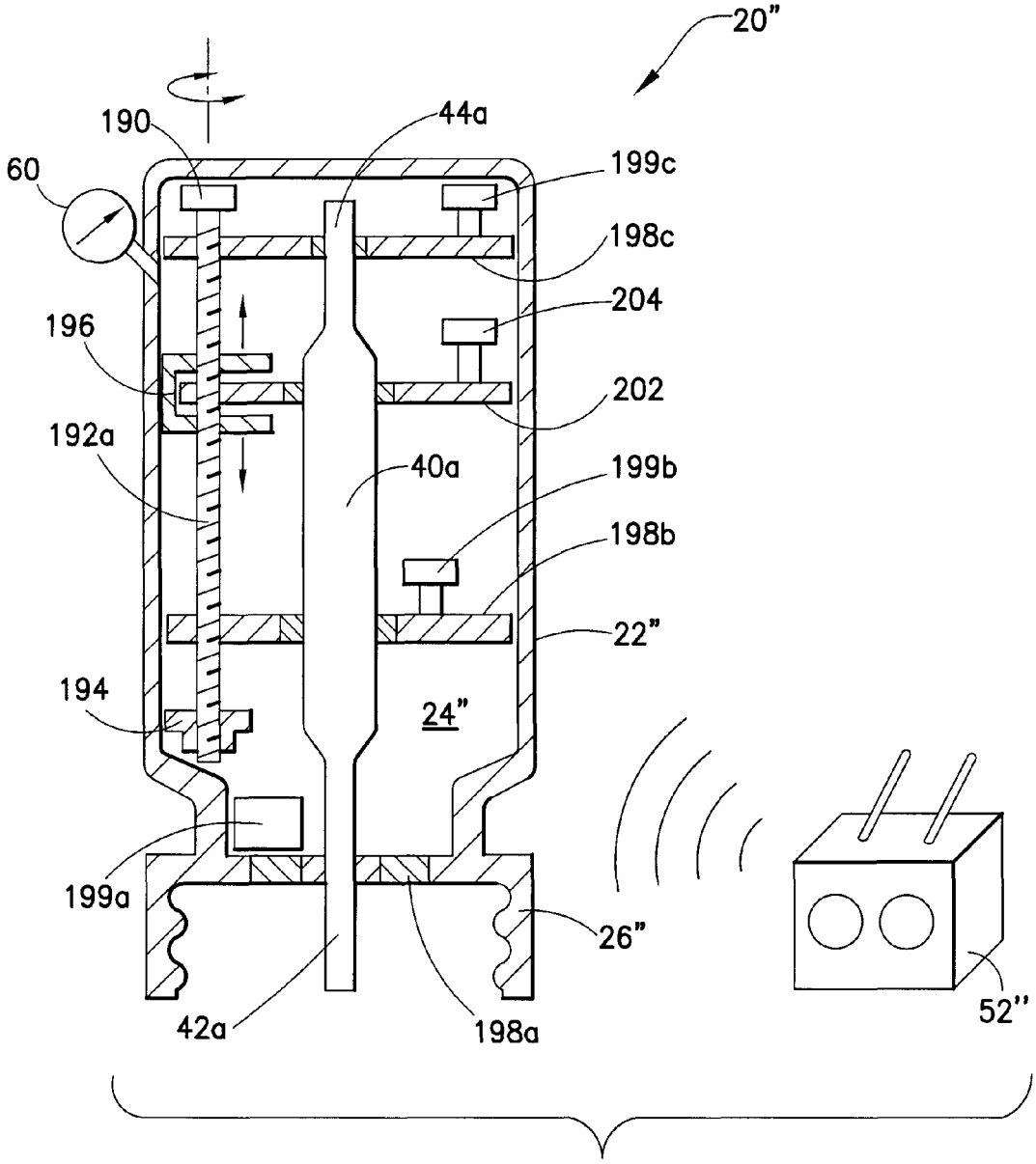
FIG. 8 is a sectional schematic view of another embodiment of a pressure-compensating wellbore deployment system including an embodiment of a clamping thrust unit according to the present invention.

An alternative embodiment of a wellbore deployment system 20" is illustrated in FIG. 8. The wellbore deployment system 20" includes an open-ended pressurizable vessel 22". A first reversible seal 198*a* is positioned adjacent to an open end 26" of the pressurizable vessel 22". The reversible seal 198*a* can include a deployable structure controllable by a first reversible seal actuator 199*a*. One or more additional reversible seal actuators 198*b*, 198*c* can be positioned within the cavity of the pressurizable vessel 22", for example, at different axial positions along an elongated tool 40*a* when positioned within the cavity. As shown, a second reversible seal 198*b* is positioned at a lower midsection of the logging tool 40*a*. The second reversible seal 198*b* can also include a deployable structure operatable by a second reversible seal actuator 199*b*. Alternatively or in addition, a third reversible seal 198*c* can be positioned toward a proximal end 42*b* of the logging tool 40*a*. A third reversible seal actuator 199*c* can also be provided to operate a deployable structure of the third reversible seal 198*c*. In some embodiments, the reversible seals 198*a*, 198*b*, 198*c* can act independently to open and close against an adjacent outer surface of the logging tool 40*a*.

In the exemplary embodiment of the wellbore deployment system 20", an axial translation actuator providing a thrust to the logging tool 40*a* includes an elongated threaded drive shaft 192*a* positioned parallel and adjacent to the logging tool 40*a*. At one end of the elongated threaded drive shaft 192 a bearing 194 is positioned allowing rotation of the extended threaded drive shaft 192*a*. At an opposite end of the elongated threaded drive shaft 192*a*, a rotary actuator 190 capable of providing a torque is positioned to controllably rotate the elongated threaded drive shaft 192*a*. In the exemplary embodiment, a reversible clamp 202 is positioned along the logging tool 40*a* as shown. The reversible clamp 202 includes a clamp actuator 204 actuating the clamp between an open and closed or clamped position. In a clamped position, an interior perimeter of the reversible clamp 202 is urged into a frictional engagement with an external surface of the logging tool 40*a*. The reversible clamp 202 is not directly attached to an internal surface of the cavity 24" of the pressurizable vessel 22", such that the reversible clamp 202 can move freely along an elongated axis of the internal cavity 24". Preferably, the reversible clamp 202 is coupled to the elongated threaded drive shaft 192*a* through a drive coupling 196.

In the exemplary embodiment, the rotary actuator 190 when actuated creates a torque transferred to the elongated drive shaft 192*a* causing a rotation of the drive shaft 192*a* along its axis. The drive coupling 196 includes at least one female thread configured to engage a thread of the elongated threaded drive shaft 192 such that rotation of the drive shaft 192 urges the drive coupling 196 in a preferred direction depending upon the direction of the rotation. For example, clockwise rotation of a right-hand threaded elongated threaded drive shaft 192 will urge the drive coupling 196 upward toward the rotary actuator 190. A rotation of the elongated drive shaft 192*a* in an opposite direction will urge the drive coupling 196 in an opposite direction. The one or more actuators 199*a*, 199*b*, 199*c*, 204, and 190 can be operated by a remote control 52" as shown.

The open end 26" of the pressurizable vessel 22" can be attached to an open end of a wellhead fixture as described above in relation to FIG. 7A through FIG. 7D. In a logging tool insertion procedure, pressures may be controlled within the pressurizable vessel 22" to equalize it to a pressure within the well. Operation of the reversible seal 198*a* can be controlled to open. Any reversible seals within the wellhead fixture can also be opened at this time having the pressurizable vessel 22" attached to the wellhead fixture with equalized pressures. In preparation for axial translation, the rotary actuator urges the drive coupling 196 toward a proximal end 44*a* of the logging tool 40*a*, while the reversible clamp 202 is unclamped. The reversible clamp 202 is next actuated to clamp against an adjacent external surface of the logging tool 40*a*. Once securely clamped, the rotary actuator 190 is operated to turn the elongated threaded drive shaft 192*a* in an opposite direction to thrust the logging tool 40*a* into an open end of the well. If translation of the drive coupling 196 along the elongated threaded drive shaft 192 is limited such that it is unable to completely insert the logging tool 40*a* into the open end of the well in one clamped position, one or more of the reversible seals 198*a* can be actuated to seal against an external surface of the logging tool 40*a* holding it in position. The reversible clamp 202 can then be released and the rotary actuator 190 rotated again in an opposite direction urging the drive coupling in a proximal direction. For example, in an insertion process, the drive coupling would be urged upward towards the top of the pressurizable vessel 22", but not beyond a proximal end 42*b* of the logging tool 40*a*. The reversible clamp 202 can then be actuated again to clamp against an adjacent surface of the logging tool 40*a* and the process repeated to further thrust the logging tool 40*a* into the open end of the well. This process can be repeated further until the logging tool 40*a* is suitably inserted within the well.

Removal of the logging tool can be accomplished by essentially reversing the above steps. For example, the drive coupling 196 can be positioned towards the open end 26" of the pressurizable vessel 22". The reversible clamp 202 can be operated to clamp against a proximal end 44*a* of a logging tool 40*a* partially exposed from the open end of the well. The rotary actuator 190 can be operated to turn an elongated threaded drive shaft 192*a* to urge the drive coupling 196 in an upward direction, thereby pulling the logging tool 40*a* out from the open end of the well and into an internal cavity of the pressurizable vessel 22".

Figure 9:
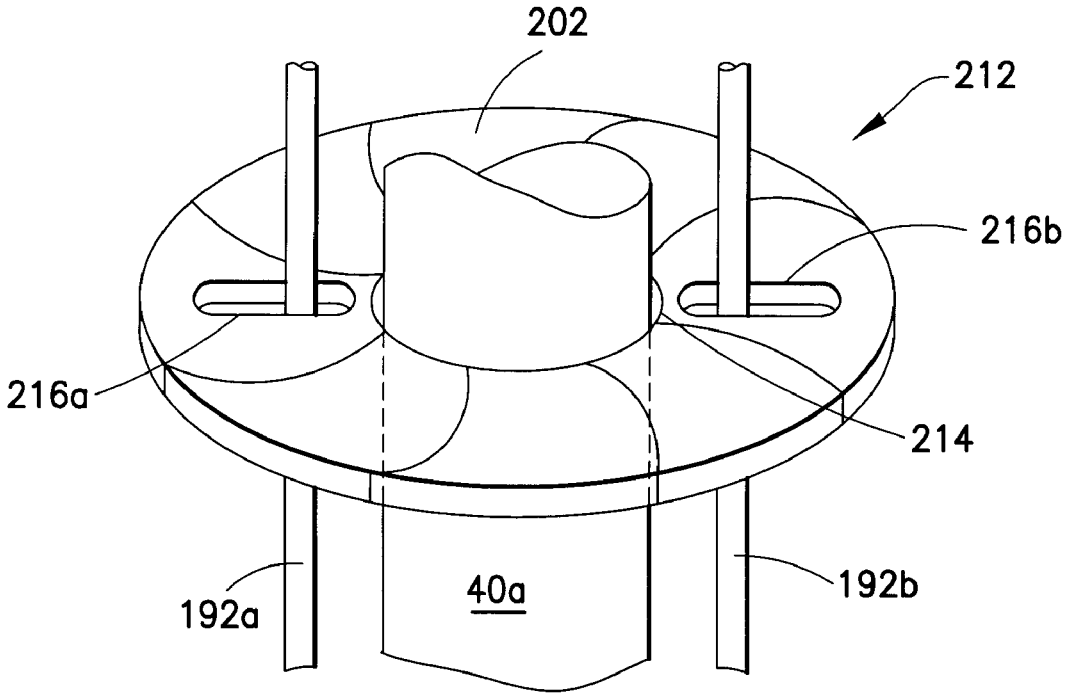
FIG. 9 is a perspective view of an embodiment of a reversible clamp of the clamping thrust unit of FIG. 8.

An exemplary embodiment of a reversible clamp 202 is illustrated in more detail in FIG. 9. The reversible clamp 202 includes a deployable structure 212. The deployable structure 212 includes one or more apertures 216*a*, 216*b* to allow passage of one or more elongated threaded drive shafts 192*a*, 192*b* therethrough. The deployable structure 212 can be an annular structure similar to those described above in relation to the reversible seals. The annular structure 212 includes an internal perimeter 214 adapted to frictionally engage an adjacent outer surface of the logging tool 40*a*. Once clamped, the drive coupling 196 (not shown) urges the reversible clamp 202, now clamped to the logging tool, in a preferred direction according to the rotation of the extended threaded drive shafts 192*a*, 192*b*. Slots 216*a*, 216*b* allow for travel of the clamp 202 within the internal cavity of the pressurizable vessel 22".

Figure 10:
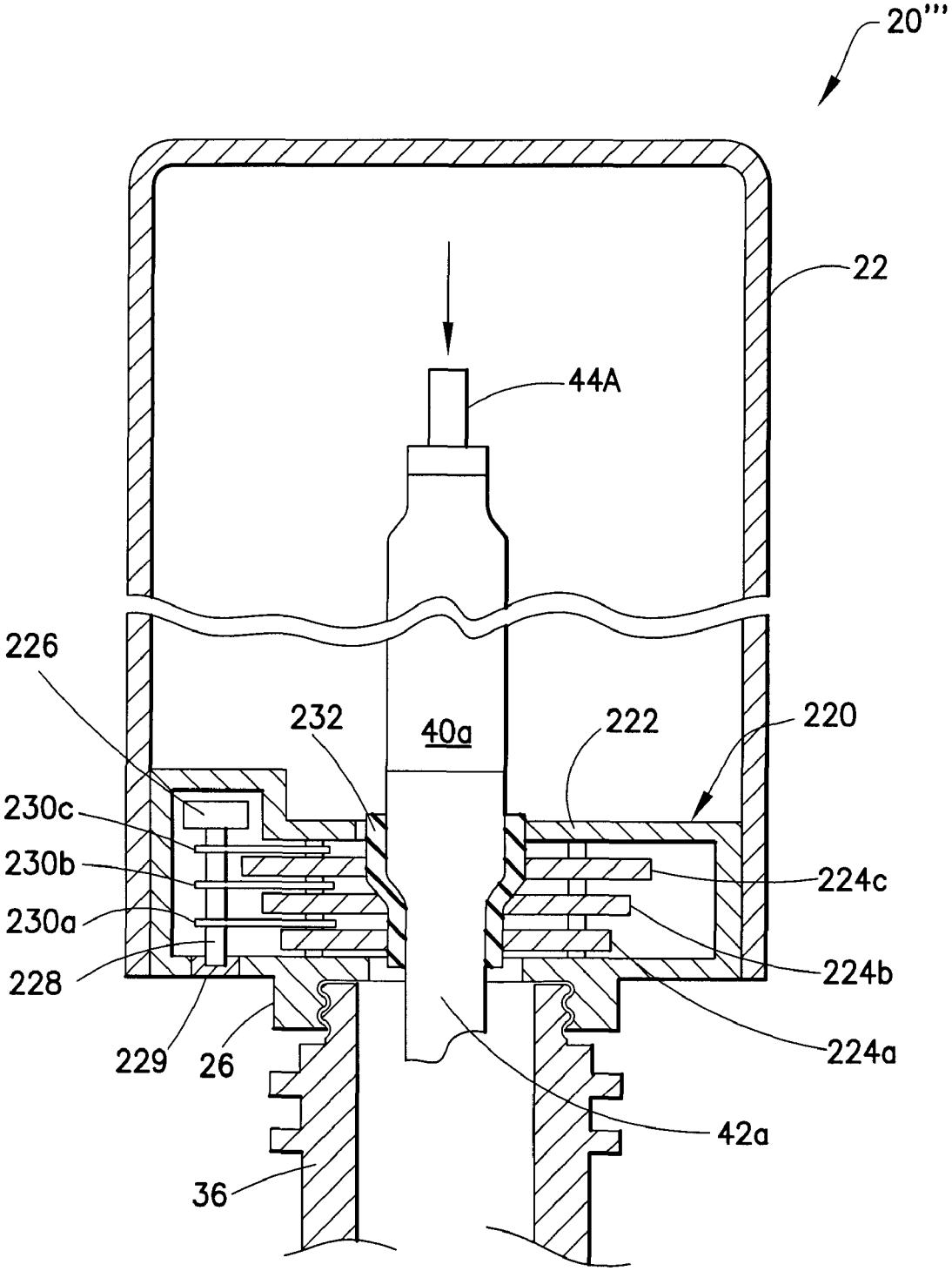
FIG. 10 is a sectional schematic view of another embodiment of a pressure-compensating wellbore deployment system including an alternative embodiment of a thrust unit according to the present invention.

FIG. 10 illustrates an alternative embodiment of a wellbore deployment system 20'" including an axial thrust unit 220. The wellbore deployment system 20'" includes an open-ended vessel 22'" having an open end 26'" coupled to an open end of the wellhead fixture 36. The thrust unit 220 includes a frame or housing 222 securely attached relative to the wellhead fixture 36. The housing 222 includes an array of two or more annular deployable structures 224*a*, 224*b*, 224*c* (generally 224). Central openings of the annular deployable structures 224 are aligned with an axis of the open end of the wellhead fixture 36. Each of the deployable structures 224 is independently configured to vary its respective internal aperture between open and closed positions. Generally, in a closed position, a perimeter of the internal aperture is urged against an exterior surface of a logging tool 40*a* disposed therein. In an open position, the perimeter of the internal aperture is not clamped against the logging tool 40*a*.

The housing 222 also includes a first deployable structure actuator 226 for varying an internal aperture of one or more of the annular deployable structures 224. The first actuator 226 can include a rotary motor providing torque to an elongated drive shaft 228. The drive shaft 228 is coupled between the motor 226 and a bearing 229 positioned at an opposite end of the drive shaft 228. The drive shaft rotates along an axis parallel to the logging tool 40*a*, which is aligned within an open cavity of the pressurizable vessel 22'". A respective linkage 230*a*, 230*b*, 230*c* (generally 230) is provided between the elongated drive shaft 228 and each of the deployable structures 224. Rotation of the motor 226 rotates the elongated axle 228 operating the linkages 230 to initiate a dimensional variation of an internal aperture of the respectively coupled deployable structures 224. In some embodiments, each of the deployable structures 224 includes a respective actuator.

In some embodiments, the array of annular deployable structures 224 can be operated to provide a thrust initiating vertical displacement of the logging tool 40*a*. In some embodiments, thrust can be generated by having each of the annular deployable structures 224 expanding and contracting according to a sequence of expansions and contractions with respect to the other annular deployable structures 224 of the array. In some embodiments, the sequence of expansions and contractions forms an undulating wave directed along the axis of the elongated logging tool 40*a*. A flexible tubular membrane 232 can be positioned between an interior edge of each of the annular deployable structures and an adjacent external surface of the logging tool 40*a*. Where a layer of fluid is trapped between the tubular membrane 232 and the outer surface of the logging tool 40*a*, the annular wave pushes against the fluid causing the tool 40*a* within the tubular membrane 232 to be displaced vertically, in the direction of the traveling wave. Such a configuration can be compared to snail locomotion.

In some embodiments, one or more of the deployable structures are also translatable at least to a limited extent along the axis of the well. A second actuator, not shown, can be provided to translate one or more of the deployable structures along the axis. In some embodiments, the second actuator uses a threaded shaft and bracket similar to that described in relation to FIG. 8. Alternatively or in addition, the second actuator includes one or more expandable elements, such as a piston, a piezoelectric device, or a shape memory alloy device. In such embodiments, expansion or contraction of the expandable member urges a respective one of the deployable structures along the axis. By sequencing displacements of different ones of the deployable structures with opening and closing of the structures, the thrust unit essentially "walks" the tool 40*a* in a preferred direction along the axis. Thrust units are described in more detail in U.S. patent application Ser. No. 11/962,657, entitled "Logging Tool Deployment Systems and Methods Without Pressure Compensation," filed on Dec. 21, 2007, incorporated herein by reference in its entirety.

Figure 11A:
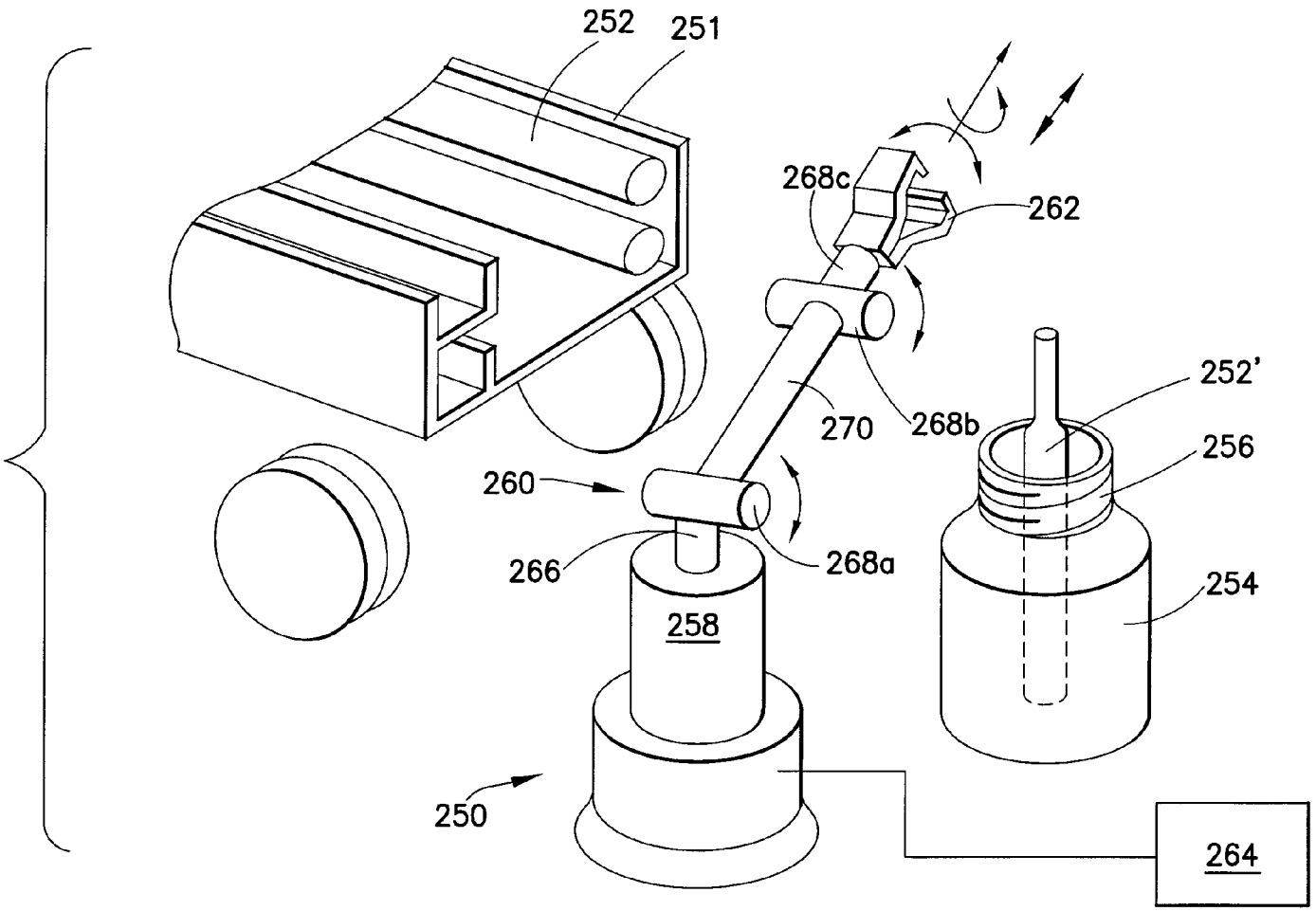
FIG. 11A through FIG. 11B are perspective views of an embodiment of a robotic system for automatically manipulating a wellbore deployment system during use according to the present invention.
Figure 11B:
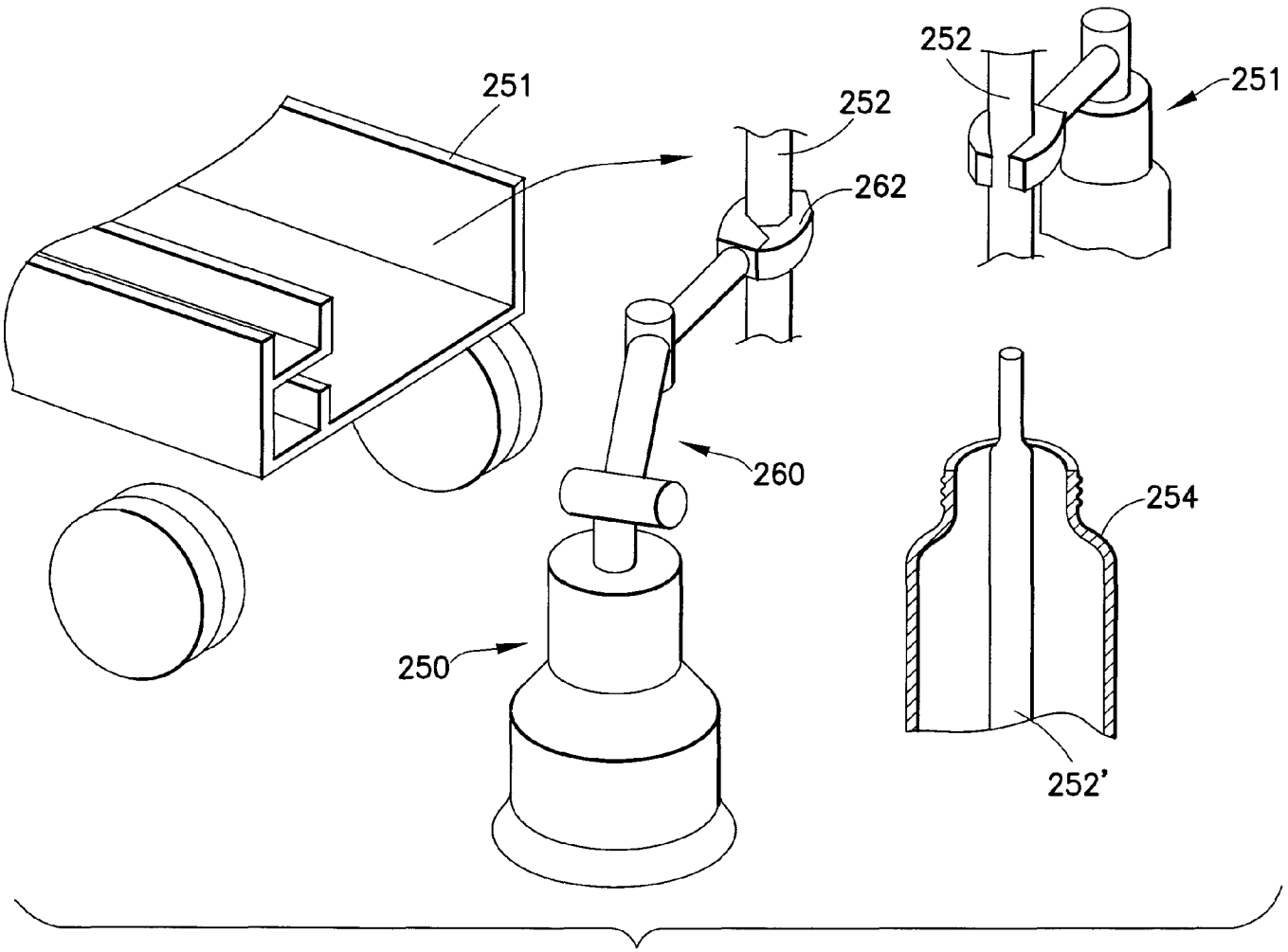

Referring now to FIG. 11A and FIG. 11B, a robotic system 250 can be provided to assist in manipulation and positioning of at least one of the downhole device 252 and the pressurizable vessel 254. A pick-and-place robotic system 250 can include a base member 258 and a positionable arm 260 attached at one end to the base unit 258. A releasably grasping fixture 268 is provided at an opposite end of the arm 260. In some embodiments, the releasably grasping fixture can be a clamp or a grasper 262 as shown. The elements of the pick-and-place robotic system 250 are configured to provide multiple degrees of freedom. In some embodiments, the robotic system 250 includes a controller 264 in electrical communication with the system 250. The controller 264 can include a processor executing preprogrammed instructions coupled to the robotic system 250 through a cable. Alternatively or in addition, the controller 264 includes a user interface to allow an operator to at least contribute to operation of the robotic system 250. Preferably, the robotic system 250 requires minimal operator intervention during use, to expedite manipulations of the tool 252 or vessel 254.

In some embodiments, the robotic system 250 is positioned in relation to a stowed tool 252 and an open-ended pressurizable vessel 254 such that the grasper 262 is moveable between the stowed tool 252 and the vessel 254 without having to relocate the base unit 258. The robotic system 250 includes sufficient degrees of freedom to allow the grasper 262 to access the stowed tool 252 and translate the stowed tool 252 to a position above an open end 256 of the pressurizable vessel 254. In some embodiments, the robotic system 250 is also capable of lowering the tool 252 into an internal cavity of the pressurizable vessel 254 as shown. The tools 252 can be stowed on the bed of a tool delivery vehicle such as a truck or rail vehicle as shown.

Alternatively or in addition, the robotic system 250 is configured to grasp, lift and support the pressurizable vessel 254. Preferably, the robotic system 250 is positioned in relation to the pressurizable vessel 254 and an open end of a wellhead fixture 36 (FIG. 1) such that the grasper 262 is moveable between the vessel 254 and the wellhead fixture 36 without having to relocate the base unit 258. The grasper 262 of the robotic system 250 can be configured to grasp a portion of the pressurizable vessel 254 allowing the robotic system 250 to position the pressurizable vessel above the open end of the wellhead fixture 36. Such precise robotic manipulation of tools 252 and/or pressurizable vessels 254 with respect to the wellhead fixtures 36 reduces the time and complexity associated with inserting and extracting tools from a well under pressure.

In some embodiments, the pick-and-place robotic system 250 includes a vertical mast 266 coupled at one end to the base unit 258 and at an opposite end to one end of an arm 260. The vertical mast 266 can be angled in some embodiments. Alternatively or in addition, the vertical mast can include an extendable portion allowing the mast to extend and contract along an axis of the mast. A first joint 268*a* is attached between the vertical mast 266 and the arm 260 allowing relative movement between the arm 260 and the vertical mast 266. The arm 260 includes a boom 270 coupled at one end to the first joint 268*a* and at an opposite end to a second joint 268*b*. A third joint 268*c* can be coupled between the second joint 268*b* and the grasper unit 262. Preferably, at least one of the base unit 258 and the vertical mast 262 is able to rotate with respect to the other.

In some embodiments, the robotic system includes a seven degrees-of-freedom (DOF) similar to that of a human arm. Such a configuration provides mobility for the robotic system 250 to grasp items such as tools 252 and/or pressurizable vessels 254 from different angles or directions. More or less degrees of freedom can be provided in various embodiments of the robotic system 250.

In some embodiments, a robotic system 251 includes a selective compliant assembly robot arm (SCARA). Such a SCARA configuration can provide a four-axis robot arm able to move to any XYZ coordinate within a work envelope. The fourth axis of motion is a wrist allowing a rotation of a grasper about the arm. Such a configuration can be accomplished with three parallel axis rotary joints. Vertical motion can be provided at an independent linear axis at the wrist or in the base of the robotic system 250. SCARA robots 251 are particularly useful in situations in which a final movement is to insert a grasped part using a single vertical move. Thus, the SCARA robot 251 is advantageous for many types of pick-and-place assembly applications, particularly those in which an elongated item is placed within a hole without binding.

Figure 12:
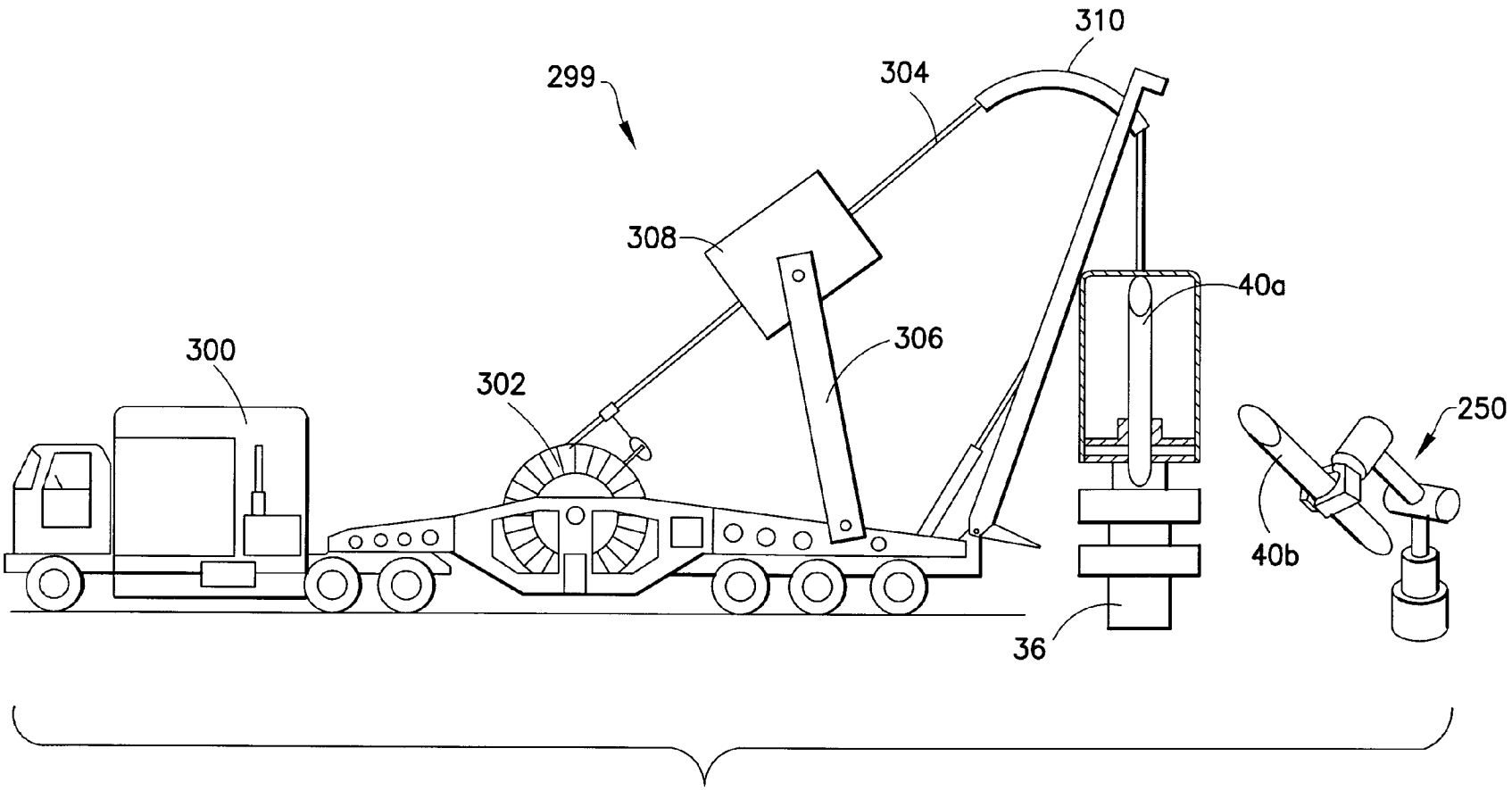
FIG. 12 is a side elevation view of an embodiment of a coiled tubing system for injecting or removing coiled tubing from a borehole according to the present invention.

FIG. 12 illustrates a general rigless coiled tubing deployment system 299 architecture in which a coiled tubing injector 204 exerts thrust onto one or more tools of a tool array. The deployment system 299 can include mobile platform, such as a truck 300 having a trailer portion with a coiled tubing reel 302 mounted thereon, onto which a length of coiled tubing 304 is at least partially wound. The system 299 also includes a coiled tubing thrust unit 308 positioned along a length of the coiled tubing 304 between the reel 302 and the tool 40*a*. In some embodiments, the thrust unit 308 is supported by a boom 306 pivotally attached to a trailer portion of the truck 300. The coiled tubing thrust unit 308 is configured to apply a linear force directed along a length of coiled tubing. Preferably, the coiled tubing thrust unit 308 is reversible, providing thrust in either direction along the length of coiled tubing. Exemplary coiled tubing thrust units 308, also referred to as variable injectors, are described in U.S. Pat. No. 5,890,534.

During an insertion procedure, the coiled tubing thrust unit 308 provides a thrust directed away from the coiled tubing reel 302. The thrust unit 308 extracts a length of coiled tubing 304 from the reel and directs it upward at a slope and through a bend 310 into vertical alignment above the tool 40*a*. The tool 40*a* can be at least partially positioned within a wellhead fixture 36 as illustrated. Thrust applied by the coiled tubing thrust unit 308 extracts greater lengths of coiled tubing 304 from the coiled tubing reel 302, forcing it around the bend 310 and directing it downward into the well. The wellhead fixture 36 can include seals adapted to seal against the coiled tubing allowing the coiled tubing to thrust the tool 40*a* further downhole while maintaining pressure differential within the well. Also illustrated is a robotic system 250 adjacent to the wellhead fixture 36 that can be used in combination with the rigless coiled tubing system 299. The robotic system 250 is shown grasping a second instrument 40*b* in anticipation for positioning it above an open end of the wellhead fixture 36 once the first instrument has been inserted. The end of the coiled tubing 304 coupled to the first tool 40*a* can be disconnected once the first tool 40*a* is sufficiently inserted into the open end of the wellhead fixture 36, and reconnected to a proximal end of the second tool 40*b*. The process can be repeated as necessary for additional tools of a tool array.

In some embodiments the coiled tubing thrust unit 308 provides positive or negative thrust to the coiled tubing 304, to convey a logging tool 40*a* with respect to a wellhead fixture 36. The pressurizable vessel of a wellbore deployment system can be removed after a logging tool 40*a* has been inserted into the wellhead fixture 36 to provide access to the logging tool 40*a*. Preferably, a proximal end of the logging tool 40*a* remains exposed or accessible from an open end of the wellhead fixture 36. A distal end of the coiled tubing 304 can be coupled to the proximal end of the partially exposed logging tool 40*a*, for example, using a toolhead coupler 186 (FIG. 7C). The coiled tubing thrust unit 308 can then be used to further deploy the logging tool 40*a* to a desired depth within the well.

In a removal process, an opposite directed thrust can be provided by the coiled tubing thrust unit 308 drawing the logging tool 40*a* up from a depth within a well bore. Preferably, the tool 40*a* is drawn upward until at least a proximal portion is exposed or accessible from the open end of the wellhead fixture 36. The distal end of the coiled tubing 304 can be decoupled from the proximal end of the partially exposed logging tool 40*a*. Once the proximal end of the tool is accessible from an open end of the wellhead fixture 36, a wellbore deployment system can be used to remove the logging tool 40*a* from the wellhead fixture 36, for example, using a pressure compensated chamber according to the present invention.

Figure 13:
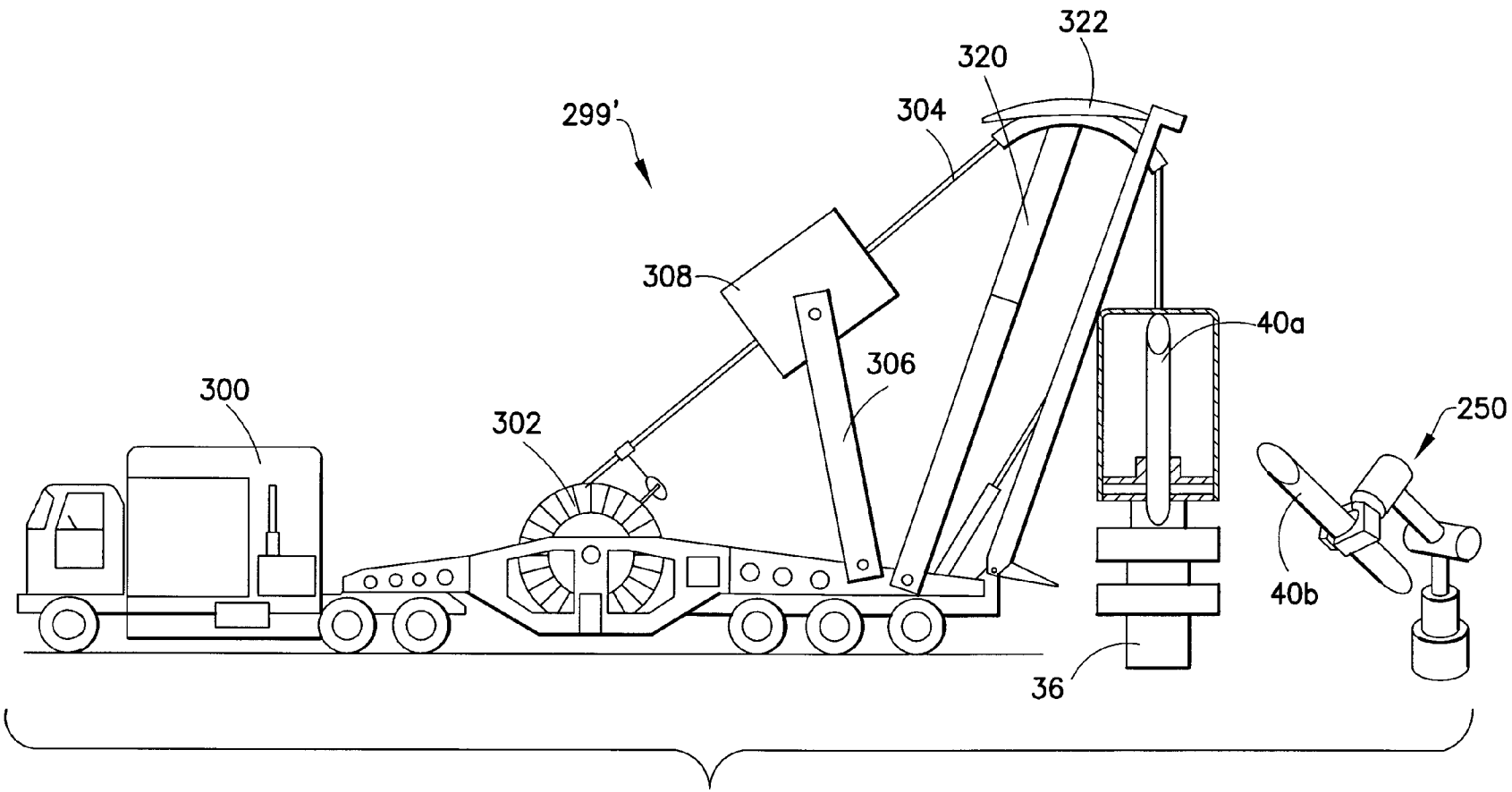
FIG. 13 is a side elevation view of another embodiment of a coiled tubing system for injecting or removing coiled tubing from a borehole according to the present invention.

An alternative embodiment of a coiled tubing deployment system 299' is illustrated in FIG. 13. In this embodiment, a second boom 320 is provided attached at a base end to a portion of the truck 300 and having at its opposite end a bearing surface 322. The second boom is positioned between the coiled tubing thrust unit 308 and the wellhead fixture 36. Preferably, the second boom aligns the bearing surface 322 at the bend 310 portion of the coiled tubing. The bearing surface 322 can be used to assist in directing the coiled tubing 304 around the bend from the coiled tubing thrust unit 308 and into vertical alignment with a proximal end of logging tool 40*a* or wellhead fixture 36.

While this invention has been particularly shown and described with references to preferred embodiments thereof, it will be understood by those skilled in the art that various changes in form and details may be made therein without departing from the scope of the invention encompassed by the appended claims.

What is claimed is:

1. A method for transferring a downhole device through a reversibly sealable wellhead fixture capping a well under pressure, comprising:

providing a pressurizable vessel having an open end and defining a cavity therein configured to retain the downhole device;

attaching the open end of the pressurizable vessel to the reversibly sealable wellhead fixture;

opening the reversibly sealable wellhead fixture, providing access to the well under pressure;

transferring the downhole device between the cavity of the pressurizable vessel and the well under pressure;

sealing the reversibly sealable wellhead fixture with respect to the pressurizable vessel; and removing the pressurizable vessel from the open end of the well under pressure.

2. The method of claim 1, wherein the act of attaching the open end of the pressurizable vessel to the reversibly sealable wellhead fixture comprises forming a pressure-tight coupling between the open end of the pressurizable vessel and the reversibly sealable wellhead fixture.

3. The method of claim 1, wherein the act of transferring the downhole device comprises advancing the downhole device from the pressurizable vessel into an open end of the reversibly sealable wellhead fixture.

4. The method of claim 1, wherein the act of transferring the downhole device comprises retrieving the downhole device from an open end of the reversibly sealable wellhead fixture and storing the downhole device within the cavity of the pressurizable vessel.

5. The method of claim 1, wherein the act of transferring the downhole device comprises coupling one end of a wire to the downhole device and moving the coupled end of the wire along the wellbore axis.

6. The method of claim 5, further comprising rotating a reel coupled to another end of the wire.

7. The method of claim 1, wherein the act of transferring the downhole device comprises:

providing at least two clamps disposed within the pressurizable vessel and spaced apart along a wellbore axis;

clamping an adjacent outer surface of the downhole device with respect to the pressurizable vessel using a first one of the at least two clamps;

translating the clamped first one of the at least two clamps along the wellbore axis with respect to a second one of the at least two clamps, translation of the clamped first one of the at least two clamps also translating the downhole device by a corresponding distance;

clamping an adjacent outer surface of the downhole device with respect to the pressurizable vessel using a second one of the at least two clamps; and unclamping the first one of the at least two clamps, wherein translation of the first one of the at least two clamps translates the downhole device along the wellbore axis.

8. The method of claim 7, wherein the act of clamping comprises controlling an actuator configured to adjust a respective one of the at least two clamps between clamped and unclamped positions.

9. The method of claim 8, further comprises sensing a clamping pressure exerted between at least one of the at least two clamps and at least one of the respective adjacent outer surface of the downhole device and an interior surface of the cavity.

10. The method of claim 9, wherein the act of controlling the actuator further comprises adjusting a degree of clamping at least one of the at least two clamps responsive to the respectively sensed clamping pressure.

11. The method of claim 1, further comprising attaching a distal end of a coil tube to a proximal end of the downhole device, the coil tube capable of transferring thrust to the proximal end of the downhole device for advancing the downhole device along an axis of the wellbore.

12. The method of claim 1, further comprising elevating an internal pressure of the pressurizable vessel.

13. The method of claim 1, further comprising returning an elevated internal pressure of the pressurizable vessel to atmospheric pressure.

14. The method of claim 1, further comprising:

transferring the pressurizable vessel between a transport location and the reversibly sealable wellhead fixture; and positioning the open end of the pressurizable vessel relative to an open end of the reversibly sealable wellhead fixture, wherein at least one of the acts of transferring or positioning is accomplished robotic ally.

15. An apparatus for transferring a downhole device across an open end of a well under pressure, comprising:

a pressurizable vessel defining therein a cavity open at one end and configured to retain a downhole device;

an operable seal positioned in relation to the open end of the cavity and operable to seal the cavity against an external pressure;

a mounting flange configured to mount the pressurizable vessel to a reversibly sealable wellhead fixture capping a well under pressure; and a thrust unit disposed within the cavity and configured to transfer the downhole device between the cavity and the wellbore through the reversibly sealable wellhead fixture, wherein transfer of the downhole device is accomplishable at an elevated pressure.

16. The apparatus of claim 15, wherein the operable seal comprises at least one dynamic clamp operable between unclamped and clamped configurations, the at least one dynamic clamp configured to clamp an adjacent outer surface of the downhole device with respect to the pressurizable vessel.

17. The apparatus of claim 16, wherein the at least one dynamic clamp includes an annulus having an adjustable interior aperture fitted along an edge with a compliant material configured to form a sealing engagement between the interior aperture and the adjacent outer surface of the downhole device.

18. The apparatus of claim 17, further comprising at least one sensor configured to monitor a clamping pressure exerted between at the at least one dynamic clamp at least one of a respective adjacent outer surface of the downhole device and an interior surface of the cavity.

19. The apparatus of claim 18, further comprising an actuator configured to adjust the annulus between clamped and unclamped configurations.

20. The apparatus of claim 19, further comprising a controller in communication with the at least one sensor and the actuator, the controller configured to adjust the interior aperture of the annulus to a clamped configuration sufficiently clamped to ensure a sealing engagement between the edge of the interior aperture and the respective adjacent outer surface of the downhole device.

21. The apparatus of claim 15, wherein the actuator comprises:

a rotatable reel; and a wire coupled between the rotatable reel and the downhole device, wherein transfer the downhole device is accomplishable by rotating the rotatable reel.

22. The apparatus of claim 15, wherein the actuator comprises:

at least two clamps disposed within the cavity of the pressurizable vessel and spaced apart along a wellbore axis, each of the at least two clamps independently controllable to clamp the downhole device with respect to the pressurizable vessel; and an actuator also disposed within the cavity and in communication with at least one of the at least two clamps, the actuator being configured to translate the at least one of the at least two clamps along the wellbore axis with respect to the other one of the at least two clamps, translation of the at least one of the at least two clamps also translating the downhole device when clamped thereto.

23. The apparatus of claim 15, further comprising a robotic manipulator for accomplishing at least one of transferring at least one of the pressurizable vessel and the downhole device between a storage location and the open end of the well under pressure, and positioning the at least one of the pressurizable vessel and the downhole device with respect to the open end of the well under pressure.

24. The apparatus of claim 15, further comprising a valve in fluid communication with the cavity of the pressurizable vessel, configured for adjusting a cavity pressure of the pressurizable vessel.

25. A system for transferring a downhole device across an open end of a well under pressure, comprising:

a pressurizable vessel having a sealable end and defining a cavity therein configured to retain the downhole device;

means for attaching the sealable end of the pressurizable vessel to the open end of the well under pressure;

means for opening the sealable end of the pressurizable vessel with respect to the open end of the well under pressure;

means for transferring the downhole device between the cavity of the pressurizable vessel and the open end of the well under pressure;

means for sealing the open end of the well under pressure with respect to the pressurizable vessel; and means for removing the pressurizable vessel from the open end of the well under pressure, wherein transfer of the downhole device across the open end of the well under pressure is accomplishable without requiring the use of a derrick or mast.

26. A downhole cartridge device, comprising:

a pressurizable vessel defining a cavity open at one end;

an operable seal positioned in relation to the open end of the cavity and configurable between open and closed positions, the operable seal sealing the cavity against a pressure when configured in the closed position;

a mounting flange disposed relative to the open end of the cavity, configured to mount the pressurizable vessel to an open end of a well under pressure; and a downhole device disposed within the cavity of the pressurizable vessel;

an actuator disposed within the cavity of the pressurizable vessel and configured to transfer the downhole device between the cavity and the open end of the well under pressure, wherein transfer the downhole device is accomplishable in a pressurized environment having a pressure elevated from atmospheric pressure.

27. The cartridge device of claim 26, wherein the downhole device is a logging tool.

28. The cartridge device of claim 26, wherein the actuator comprises a rotatable reel and a wire coupled between the rotatable reel and the downhole device, translation of the downhole device being accomplished by rotation of the rotatable reel.

29. The cartridge device of claim 26, wherein the actuator comprises:

at least two clamps disposed within the cavity of the pressurizable vessel and spaced apart along a wellbore axis, each clamp independently controllable to clamp the downhole device with respect to the pressurizable vessel; and an actuator in communication with at least one of the at least two clamps, configured to translate the at least one of the at least two clamps along the wellbore axis with respect to the other one of the at least two clamps.

30. The cartridge device of claim 29, further comprising a respective actuator for each of the at least two clamps, each actuator adapted to operate a respective one of the at least two clamps between clamped and unclamped positions.

31. The cartridge device of claim 26, wherein the operable seal comprises a dynamic peripheral clamp operable between unclamped and clamped configurations, the dynamic peripheral clamp configured to clamp a periphery of the downhole device when in the clamped configuration.

32. The cartridge device of claim 31, wherein the dynamic peripheral clamp includes an adjustable annulus fitted along an interior edge with a compliant material configured to form a sealing engagement between the annulus and the periphery of the downhole device.

33. The cartridge device of claim 32, further comprising a sensor configured to monitor an indication of the sealing engagement between the annulus and the periphery of the downhole device.

34. The cartridge device of claim 26, wherein the mounting flange configured to mount the pressurizable vessel to at least one of: a wellhead; a blowout preventor; and a configuration of valves otherwise known as a Christmas tree.

35. The cartridge device of claim 26, further comprising a valve in fluid communication with the cavity of the pressurizable vessel, configured for adjusting a cavity pressure of the pressurizable vessel.

* * * * *